US007522114B2

(12) United States Patent
Brown et al.

(10) Patent No.: US 7,522,114 B2
(45) Date of Patent: Apr. 21, 2009

(54) HIGH GAIN STEERABLE PHASED-ARRAY ANTENNA

(75) Inventors: Forrest J. Brown, Carson City, NV (US); Forrest Wolf, Reno, NV (US)

(73) Assignee: Pinyon Technologies, Inc., Reno, NV (US)

( * ) Notice: Subject to any disclaimer, the term of this patent is extended or adjusted under 35 U.S.C. 154(b) by 12 days.

(21) Appl. No.: 11/694,916

(22) Filed: Mar. 30, 2007

(65) Prior Publication Data

US 2007/0247385 A1 Oct. 25, 2007

Related U.S. Application Data

(63) Continuation-in-part of application No. 11/055,490, filed on Feb. 9, 2005, now Pat. No. 7,202,830.

(51) Int. Cl.
*H01Q 13/10* (2006.01)

(52) U.S. Cl. ..... 343/767; 343/770

(58) Field of Classification Search ..... 343/770, 343/767, 771, 700 MS
See application file for complete search history.

(56) References Cited

U.S. PATENT DOCUMENTS

| | | | | |
|---|---|---|---|---|
| 3,705,283 | A | 12/1972 | Sayer, Jr. | |
| 3,764,768 | A | 10/1973 | Sayer, Jr. | |
| 4,958,165 | A * | 9/1990 | Axford et al. | 343/770 |
| 5,025,264 | A | 6/1991 | Stafford | |
| 5,068,670 | A * | 11/1991 | Maoz | 343/767 |
| 5,087,921 | A | 2/1992 | Kurtz | |
| 5,119,107 | A | 6/1992 | Wildey et al. | |
| 5,189,433 | A | 2/1993 | Stern et al. | |
| 5,347,287 | A | 9/1994 | Speciale | |
| 5,896,107 | A * | 4/1999 | Huynh | 343/700 MS |
| 6,130,648 | A | 10/2000 | Rulf et al. | |
| 6,285,337 | B1 | 9/2001 | West et al. | |
| 6,292,133 | B1 | 9/2001 | Lynch | |
| 6,388,621 | B1 | 5/2002 | Lynch | |
| 6,456,241 | B1 | 9/2002 | Rothe et al. | |

(Continued)

FOREIGN PATENT DOCUMENTS

EP 0 384 777 A2 8/1990

(Continued)

OTHER PUBLICATIONS

"PCT Notification of Transmittal of the International Search Report and the Written Opinion of the International Searching Authority, or the Declaration", for PCT Application No. PCT/US2006/003334, filed Jan. 30, 2006, 13 pages.

(Continued)

*Primary Examiner*—Hoang V Nguyen
(74) *Attorney, Agent, or Firm*—Holland & Hart, LLP

(57) ABSTRACT

A high gain, phased array antenna includes a conducting sheet having a number of one or more slots defined therein. For each slot, an electrical microstrip feed line is electronically coupled with a corresponding slot to form a magnetically-coupled LC resonance element. A main feed line couples with the one or more microstrip feed lines. At least one slot and/or microstrip feed line includes at least one segment with greater width than other segments.

52 Claims, 21 Drawing Sheets

U.S. PATENT DOCUMENTS

| | | | | |
|---|---|---|---|---|
| 6,611,231 | B2 | 8/2003 | Crilly, Jr. et al. | |
| 6,703,975 | B1 | 3/2004 | Freeman | |
| 7,057,569 | B2 * | 6/2006 | Isoifovich et al. | 343/770 |
| 7,129,902 | B2 * | 10/2006 | Bancroft | 343/767 |
| 7,202,830 | B1 | 4/2007 | Brown et al. | |
| 2002/0021255 | A1 | 2/2002 | Zhang et al. | |
| 2002/0171594 | A1 | 11/2002 | Fang | |
| 2003/0184477 | A1 | 10/2003 | Shafai et al. | |
| 2005/0146479 | A1 | 7/2005 | Stenger et al. | |
| 2005/0162328 | A1 | 7/2005 | Mori | |
| 2005/0259019 | A1 | 11/2005 | Miles | |
| 2006/0077113 | A1 * | 4/2006 | Yuanzhu | 343/770 |
| 2006/0139223 | A1 * | 6/2006 | Li et al. | 343/713 |
| 2007/0097006 | A1 | 5/2007 | Brown et al. | |

FOREIGN PATENT DOCUMENTS

| | | | |
|---|---|---|---|
| EP | 0 384 777 | A3 | 8/1990 |
| EP | 0 384 780 | A2 | 8/1990 |
| EP | 0 384 780 | A3 | 8/1990 |
| EP | 1854172 | A2 | 11/2007 |
| EP | 1854172 | A3 | 11/2007 |
| WO | WO 2006/086180 | A2 | 8/2006 |
| WO | 2006086180 | A3 | 2/2007 |
| WO | 2007/028448 | A1 | 3/2007 |

OTHER PUBLICATIONS

Brown, et al., "A GPS Digital Phased Array Antenna and Receiver", Proceedings of IEEE Phased Array Symposium, Dana Point, CA, May 2000, 4 pages.

Agile Phased Array Antenna, by Roke Manor Research, 2002, 2 pages.

Galdi, et al., "Cad of Coaxially End-Fed Waveguide Phased-Array Antennas", Microwave and Optical Technology Letters, vol. 34, No. 4, Aug. 20, 2002, pp. 276-281.

Data Sheet: Rogers Corporation: RO3000 Series High Frequency Circuit Materials, Publication No. 92-130, Mar. 2005, 4 pages.

Data Sheet: Rogers Corporation: RO4000 Series High Frequency Circuit Materials, Publication No. 92-004, Apr. 2006, 4 pages.

International Search Report and Written Opinion mailed on Sep. 3, 2008 for PCT Patent Application No. PCT/US2008/058797 (9 pages).

Soliman, E.A., et al., "Antenna Arrays in MCM-D Technology Fed by Coplanar CPW Networks", IEEE Transactions on Microwave Theory and Techniques, IEEE Service Center, Piscataway, NJ, US, vol. 48, No. 6, Jun. 1, 2000, pp. 1065-1068.

European Search report mailed on Nov. 25, 2008 for Appilcation No. 06719934.9 - 1248/1854172 which claims priority to PCT/US2006/003334.

* cited by examiner

Micro strip feed line to slot attachment point the line printed circuit board to this point.

Micro strip feed line to slot attachment point the line printed circuit board to this point.

HIGH GAIN STEERABLE PHASED-ARRAY ANTENNA

PRIORITY

This application is a continuation-in-part (CIP) of U.S. patent application Ser. No. 11/055,490, filed Feb. 9, 2005, now U.S. Pat. No. 7,202,830, issued Apr. 10, 2007, which is hereby incorporated by reference.

BACKGROUND

Conventional phased array antennas incorporate waveguide technology with the antenna elements. A waveguide is a device that controls the propagation of an electromagnetic wave so that the wave is forced to follow a path defined by the physical structure of the guide. Waveguides, which are useful chiefly at microwave frequencies in such applications as connecting the output amplifier of a radar set to its antenna, typically take the form of rectangular hollow metal tubes but have also been built into integrated circuits. A waveguide of a given dimension will not propagate electromagnetic waves lower than a certain frequency (the cutoff frequency). Generally speaking, the electric and magnetic fields of an electromagnetic wave have a number of possible arrangements when the wave is traveling through a waveguide. Each of these arrangements is known as a mode of propagation. It is desired to have a phased array antenna that provides enhanced functionalities and gain characteristics.

SUMMARY OF THE INVENTION

A high gain, steerable phased array antenna is provided. A conducting sheet has one or more slots, of two or more layers separated by a dielectric material, defined therein. For each of the slots, an electrical microstrip feed line is coupled with the slot to form a magnetically coupled LC resonance element. A main feed line couples with the one or more microstrip feed lines. At least one microstrip feed line includes at least one segment greater width than other segments to reduce electrical resistance and produce an enhanced q-factor to provide a selected broader bandwidth for the antenna.

The segment of greater width may include an original feed line having the width of the other segments, and an additional trace over the original feed line. The segment with greater width may have a rectangular shape.

A further high gain, phased array antenna is provided. A conducting sheet has one or more slots, of two or more layers separated by a dielectric material, defined therein. A corresponding electrical microstrip feed line is electronically coupled with each slot to form a magnetically-coupled LC resonance element. A main feed line is coupled with the one or more microstrip feed lines. At least one slot includes at least one non-rectangular segment producing a shape that provides a selected radio frequency characteristic for the antenna.

Either of these antennas may further include one or more of the following features:

The microstrip feed line may be electrically-connected to its corresponding slot, coupled across a corresponding slot from one side to another, and/or crosses the slot at the center or off-center.

A mobile phone and/or IC antenna device may include either antenna.

The one or more slots may include at least two oblong slots that overlap in a criss-cross shape design, a X-shape design, a hook-cross shape, an iron-cross or Christmas tree-shape design, or combinations thereof. The one or more slots may include a slot having bowtie-shaped design.

The one or more slots may include at least two slots of different size or shape or both, and thus different resonant frequencies. These at least two slots may overlap each other in a crossed design and/or may provide dual band or enhanced ultra wide band capability, or both.

The one or more slots may include two or more slots arranged to provide interferometric functionality.

Two or more slots may share a common feed line with different lengths from a common feed point to form a synthetic aperture.

The antenna may also include delay circuitry for electronically steering the antenna by selectively changing signal phases on the microstrip feed line, and one or more processors operating based on program code that continuously or periodically determines a preferred signal direction and controls the delay circuitry to steer the antenna in the preferred direction.

The one or more slots have an oblong shape, such as a rectangular or elliptical shape, and the microstrip feed line may extend in the short dimension of the oblong slot.

The main feed line may couple with a coax cable connector attachment.

The one or more slots may include two slots that are fed in parallel by the microstrip feed lines.

An equal number of slots may be disposed on either side of the main feed line which may be center fed with a coax cable connector attachment, thereby providing two halves of the main feed line. Each half may have the same resistance, which may be also the same total resistance as the parallel combination of the microstrip feed lines that correspond to that half of the main feed line. The input impedance of the antenna may be selected to be the same resistance as the two halves of the main feed line.

DETAILED DESCRIPTION OF THE PREFERRED EMBODIMENTS

Figure 1:
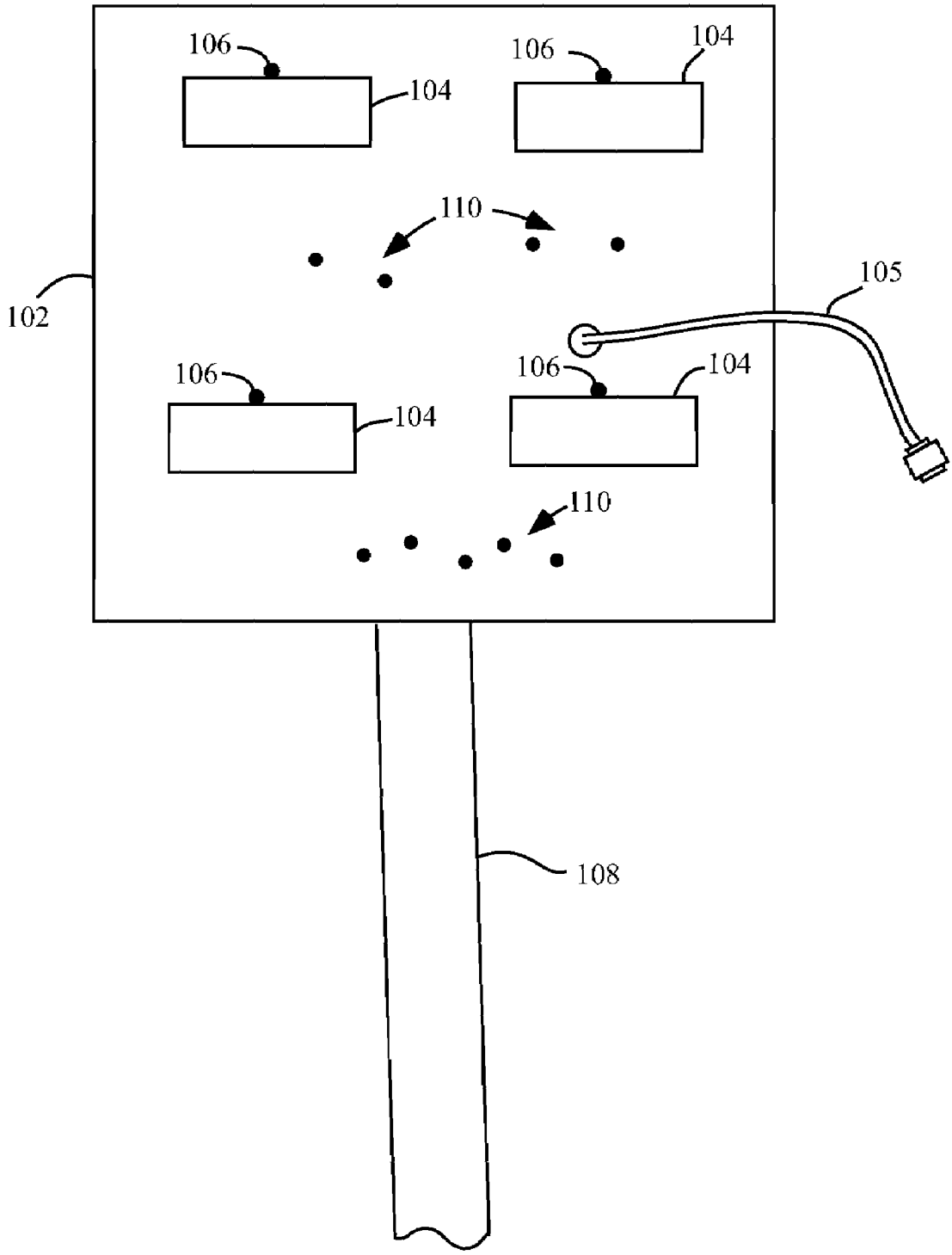
FIG. 1 illustrates a front view of a high gain steerable phased array antenna in accordance with a preferred embodiment.

Referring to FIG. 1, a high gain steerable phased array antenna in accordance with a preferred embodiment includes a conducting sheet 102. The conducting sheet 102 is preferably an area of sheet metal such as copper, of two or more layers separated by a dielectric material, and may be composed of one or more of various metals or other conductors. Four slots 104 are cut into the conducting sheet 102. More or fewer slots 104 of arbitrary number may be used, although preferably the slots 104 are arranged in such a manner that they complement each other in a phased array pattern. Each time the number of slots is doubled, the gain is increased by 3 dBi.

The slots 104 are preferably oblong and more preferably rectangular. However, the slots 104 may be square or circular or of an arbitrary shape. The preferred dimension of the sheet is 5⅞" wide by 5⅛" tall. The preferred dimensions of the rectangular slots is ⅝"×2⅛". The dimensions of the slots 104 are generally preferably a half wave (λ/2) wide and a quarter wave (λ/4) wave high. The drive impedances of the slots 104 is preferably (60)sq/73=494 ohms. An advantageous gain characteristic is achieved due to the lack of losses in the transition to free space of 377.564 ohms.

A coaxial cable 105 is connected to the sheet 102 preferably by soldering. Although FIG. 2 will show the electrical arrangement of the antenna in more detail, FIG. 1 shows four soldered connections 106 at the middles of long edges of the rectangular slots 104. A signal cable 105 is also shown in FIG. 1, along with a few other solder connections 110 to the sheet 102 from the back side.

Figure 2:
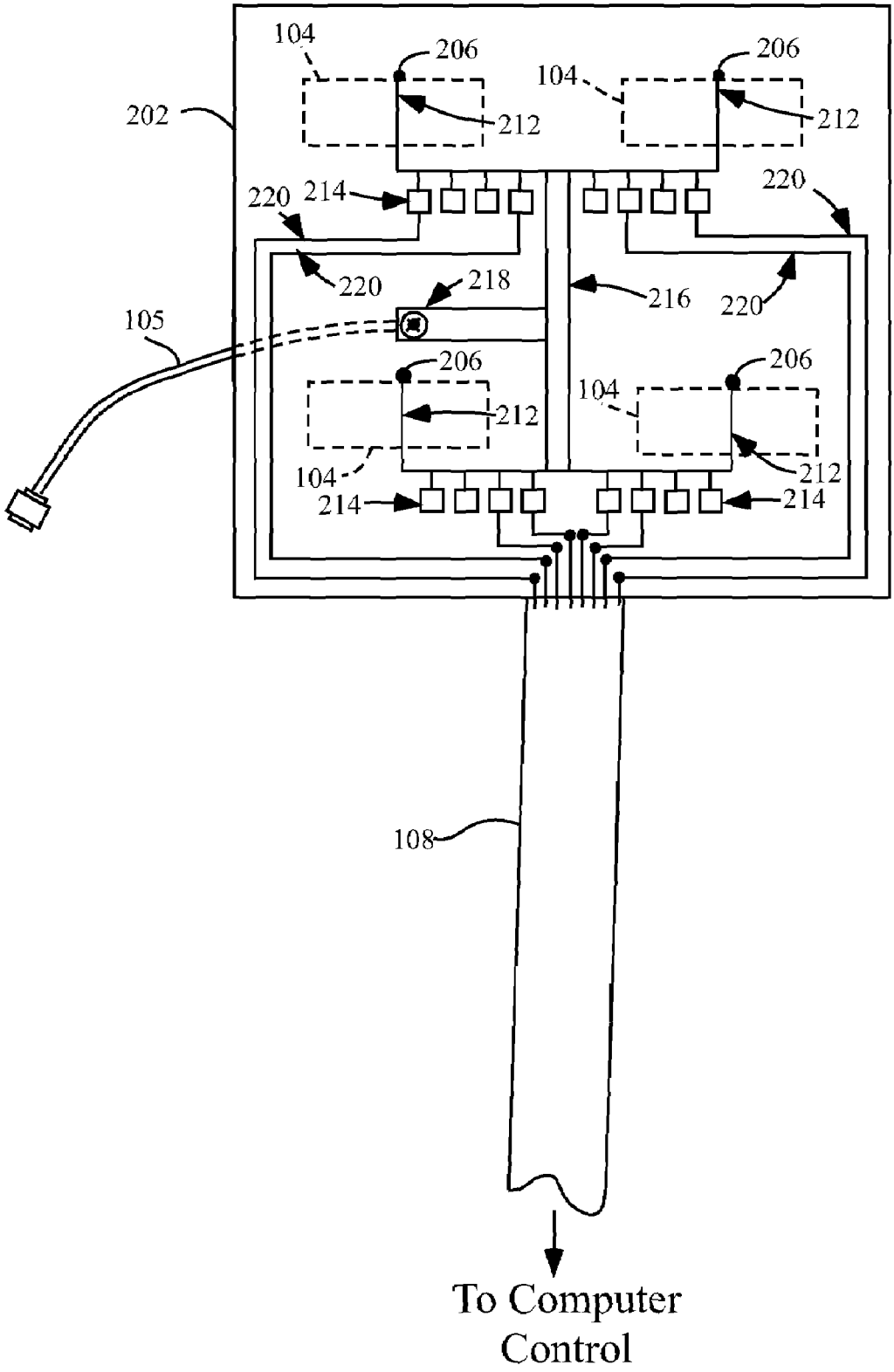
FIG. 2 illustrates a back view of a high gain steerable phased array antenna in accordance with a preferred embodiment.

FIG. 2 illustrates a back side view of a high gain steerable phased array antenna in accordance with a preferred embodiment. This side of the antenna includes a circuit board with various electrical connections. The slots 104 that are cut into the conducting sheet at the front side are shown in dotted lines in FIG. 2 for perspective as to their relative location to the electrical components on the back side. The micro strip feed line connections 206 correspond to the solder connections 106 to the conducting sheet 102 on the front side. These connections 206 are preferably at the centers of the long edges of the oblong and preferably rectangular slots 104. The connections 206 may be alternatively located at the centers of the short edges, or again the slots 104 may be squares or circles or arbitrary shapes.

The slots 104 are resonant by means of a coupling mechanism. The coupling mechanism connects to the resonant slots 104 using microstrip feed lines 212. The microstrip feed lines are constructed on a separate plane of the antenna. The resonant slots 104 are fed in parallel, preferably with 100 ohm microstrip feed lines 212. The microstrip feed lines 212 are shown crossing the short dimensions of the rectangular slots 104 at their centers. The microstrip feed lines 212 are each connected to a series of electronic circuitry components 214. In FIG. 2, each microstrip feed line 212 is has four of these components 214 illustrated as squares. These components 214 include electronic delays that permit the antenna to be directionally steerable. Preferably the components 214 include PIN diodes and inductors. The diodes may be of type diode PIN 60V 100 mA S mini-2P by Panasonic SSG (MFG P/N MA2JP0200L; digikey MA2JP0200LTR-ND), or preferably Shottky diode, Agilent p/n HSMS-2850 or equivalent. The inductors may be of type 1.0 μH +/−5% 1210 by Panasonic (MFG P/N ELJ-FA1R0JF2; digikey PCD1825TR-ND). Capacitors may be preferably 1000 pF, TDK, C1608X7R1H102K or equivalent. Resistors may be preferably 470 ohms, Yaego 9C06031A4700JLHFT or equivalent.

The antenna is electronically steered by adding the delay circuitry 214 to the microstrip feed lines 212. The delay changes the phase of the signal on the microstrip feed lines. The delay circuitry includes the PIN diodes and a pad cut into the copper plane of the circuit board. When the PIN diode is turned on, delay is added to the circuit. This means that it can be used to follow the source of the signal. The signal can originate from a wireless access point, a portable computer, or another device.

The microstrip feed lines 212 each connect to a main feed line 216. The two microstrip feed lines 212 in the upper half of the antenna of FIG. 2 are connected to the upper half of the main feed line 216, and the two microstrip feed lines 212 in the lower half of the antenna of FIG. 2 are connected to the lower half of the main feed line 216. The main feed lines is connected at its center to a coax connection segment 218 that is connected to the coaxial cable 105. Various traces 220 are shown connecting the delay pads 214 to the signal cable 108. The signal cable 108 in turn connects to computer operated control equipment.

The antenna of FIGS. 1-2 has four resonant slots 104. The top and bottom halves of the antenna are mirror images of one another. Two 100 ohm feed lines feed the two resonant slots 104 in the upper half of the antenna shown at FIG. 1. The 100 ohm feed lines are in parallel. The resulting resistance is 50 ohms. This matches the resistance of the 50 ohm main feed line 216. When the lower half of the antenna is taken into account, the center of the antenna is at 25 ohms, i.e., two 50 ohm circuits in parallel. The input impedance of the antenna is selected to be 50 ohms according to the preferred embodiment. An impedance matching pad of 35.35 ohms achieves this.

Figure 3:
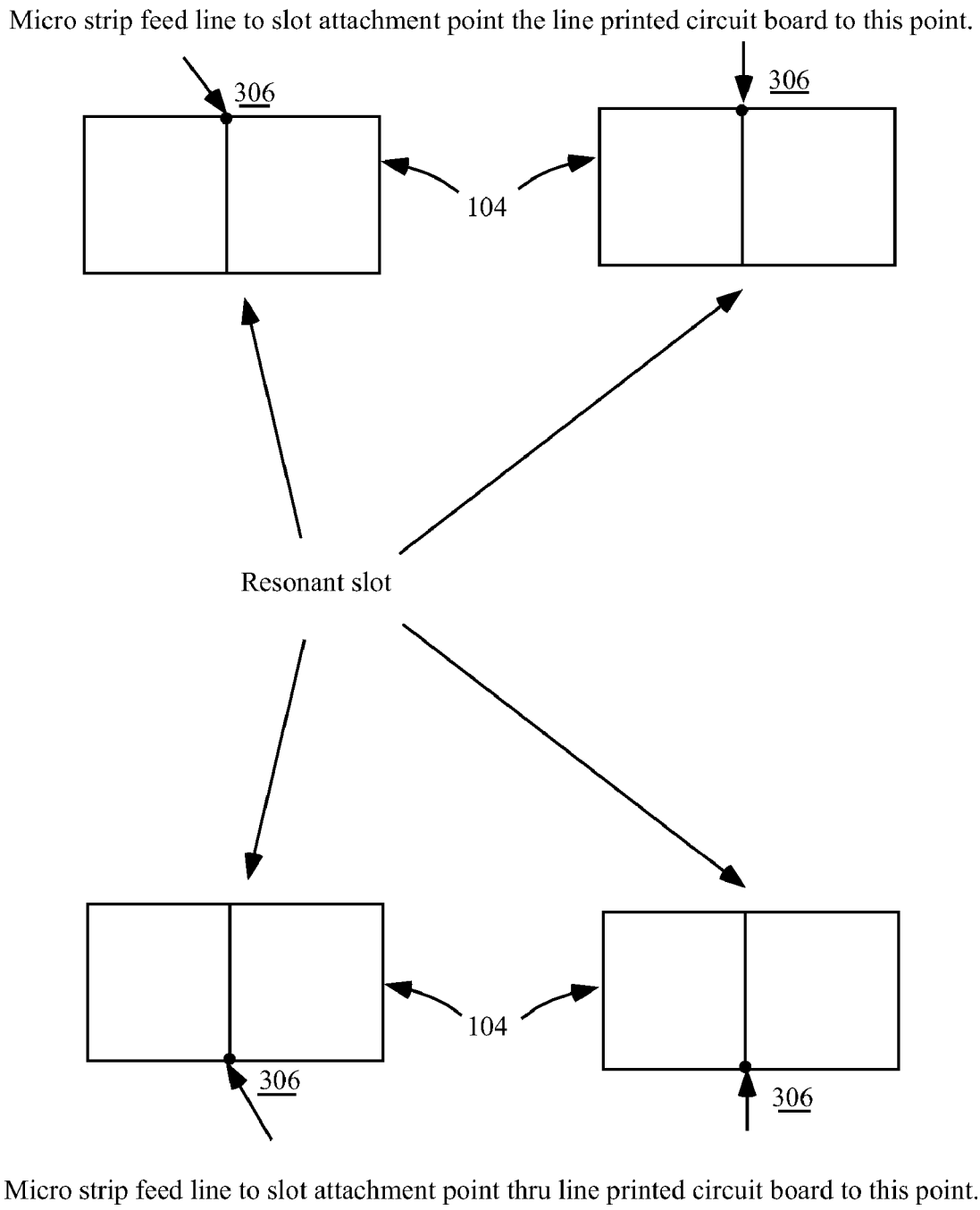
FIG. 3 illustrates micro feed line coupling to resonant slots in accordance with a preferred embodiment.

Referring now to FIG. 3, micro feed line coupling points 306 are illustrated. These coupling points 306 are at the centers of long edges of the resonant slots 104. The microstrip feed lines 212 cross the short dimensions of the slots 104. As FIG. 3 is only for illustration, only the slots 104, microstrip feed lines 212 and connections points 306 are shown. The connections 306 of the two slots 104 in the lower half of the antenna of FIG. 3 are at the lower long edges of the slots 104. In FIG. 2, they were shown connected to the upper long edges of the slots 104. The microstrip feed line connections to the two slots in the upper half of the antenna could also be to the lower edges of the slots 104. Moreover, the slots 104 and microstrip feed lines 212 could be rotated ninety degrees, or another arbitrary number of degrees, or only the slots may be rotated, or only the microstrip feed lines 212 may be rotated.

Figure 4:
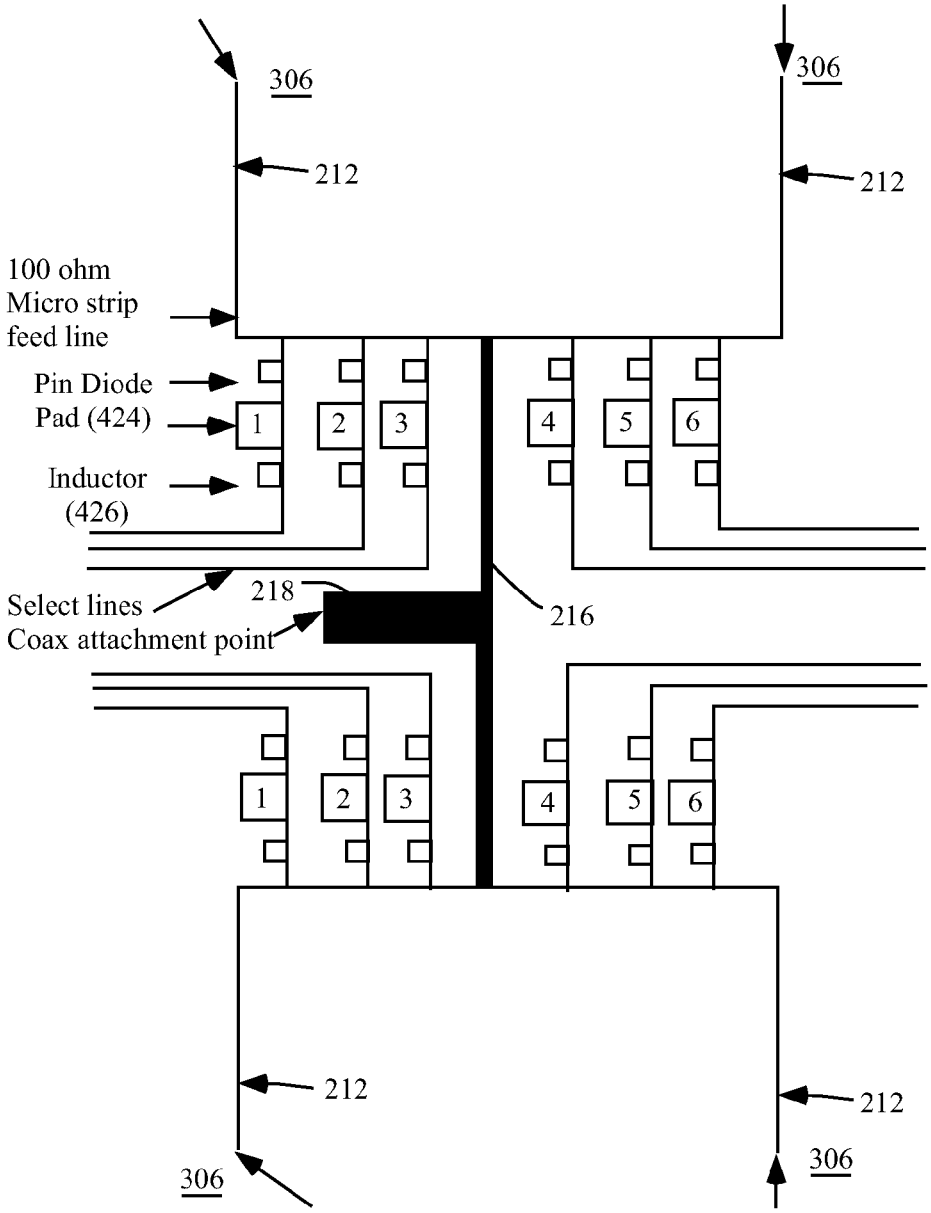
FIG. 4 schematically illustrates delay electronics coupled with microstrip feed lines for steering a phased array antenna in accordance with a preferred embodiment.

FIG. 4 schematically illustrates the delay electronics 214 coupled with the microstrip feed lines 212 for steering the phased array antenna in accordance with a preferred embodiment. Each of the microstrip feed lines 212 is shown in FIG. 4 coupled with three groups of electronics including a pin diode pad 424 and an inductor 426. The delay pads 424 are enabled and disabled by a voltage of +5 Volts and −5 Volts respectively on select lines.

Figure 5A:
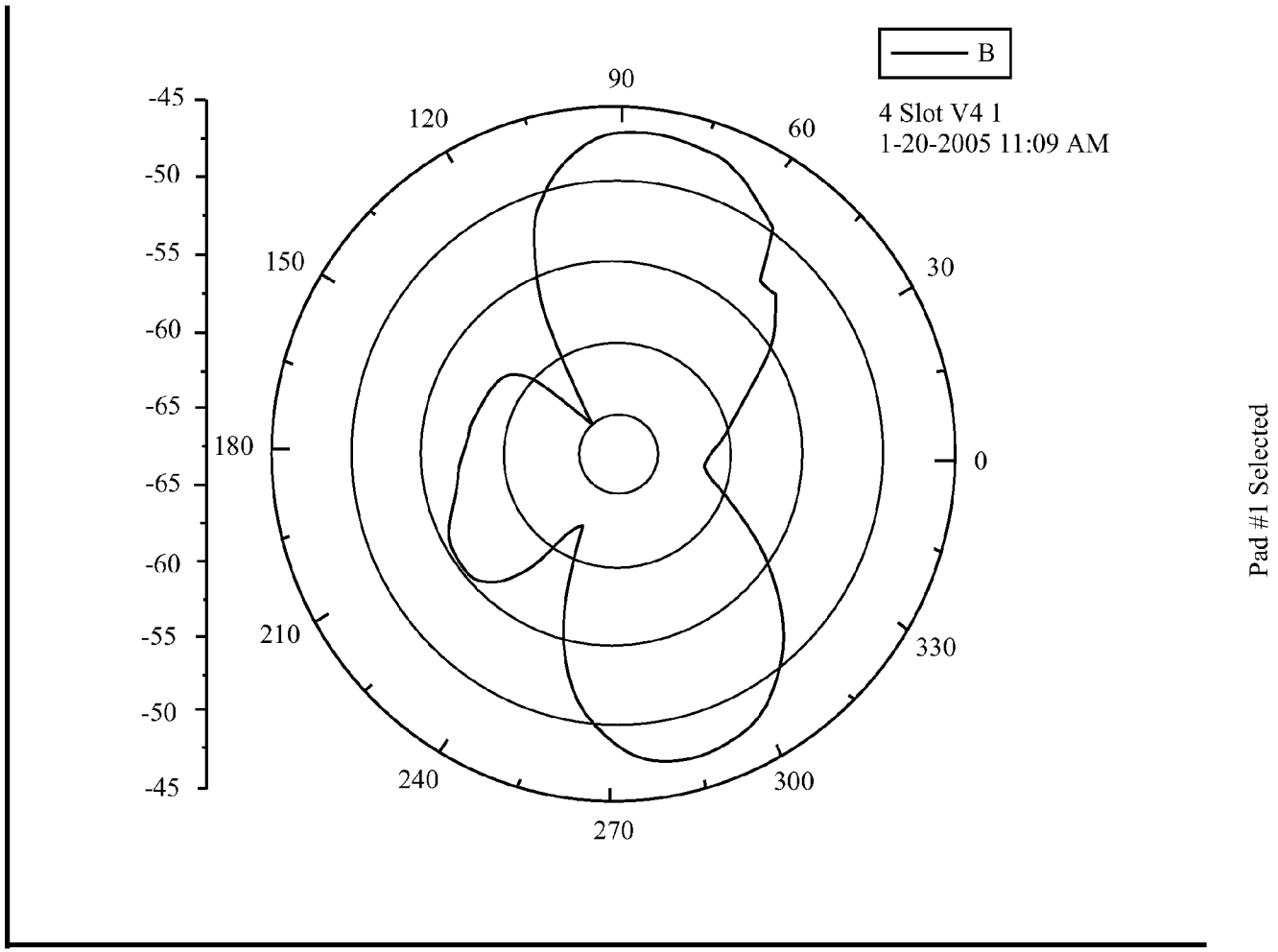
FIGS. 5A-5D show exemplary signal distribution plots in various directions based on selections of different lobes in accordance with a preferred embodiment.
Figure 5B:
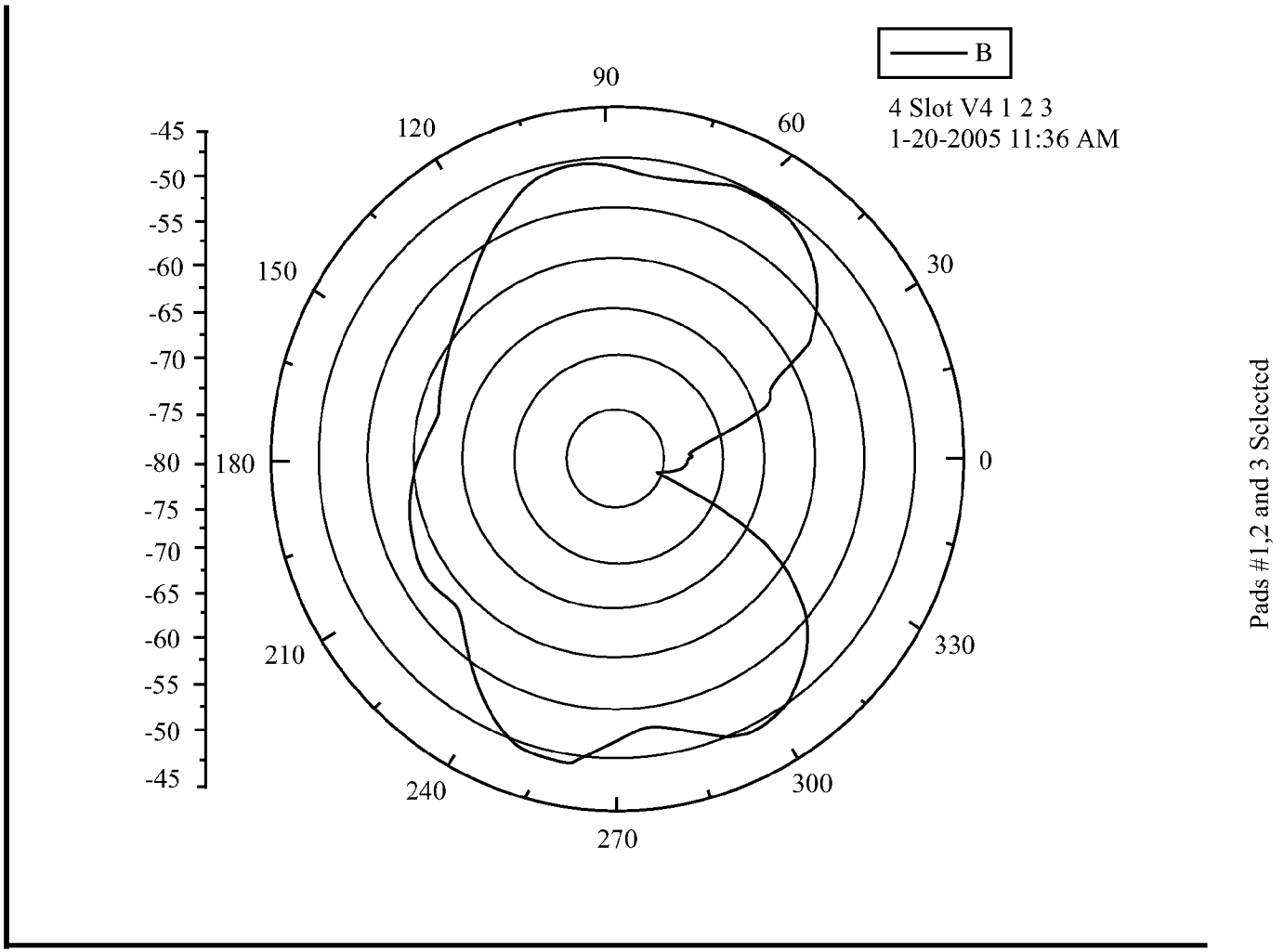
Figure 5C:
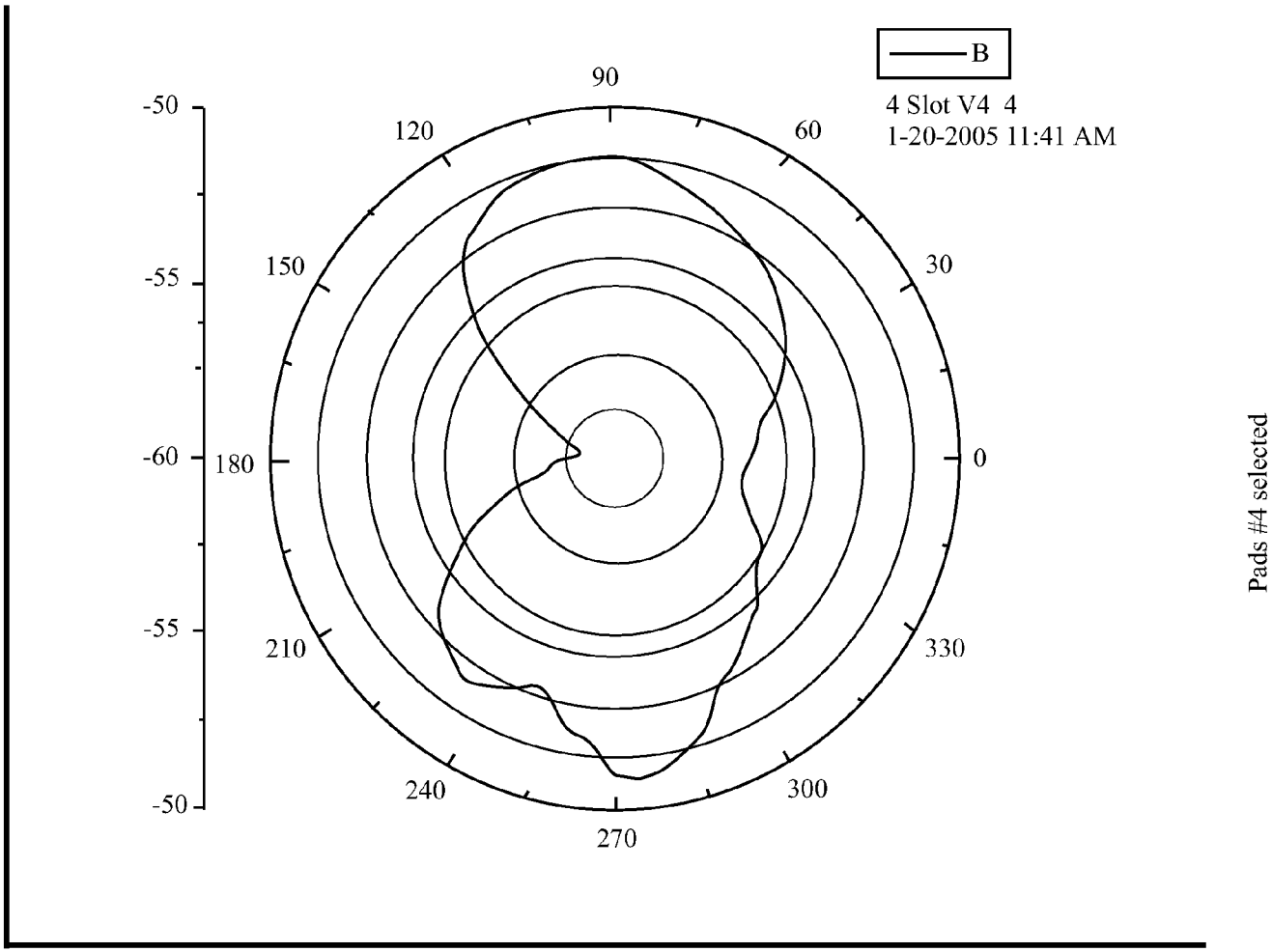
Figure 5D:
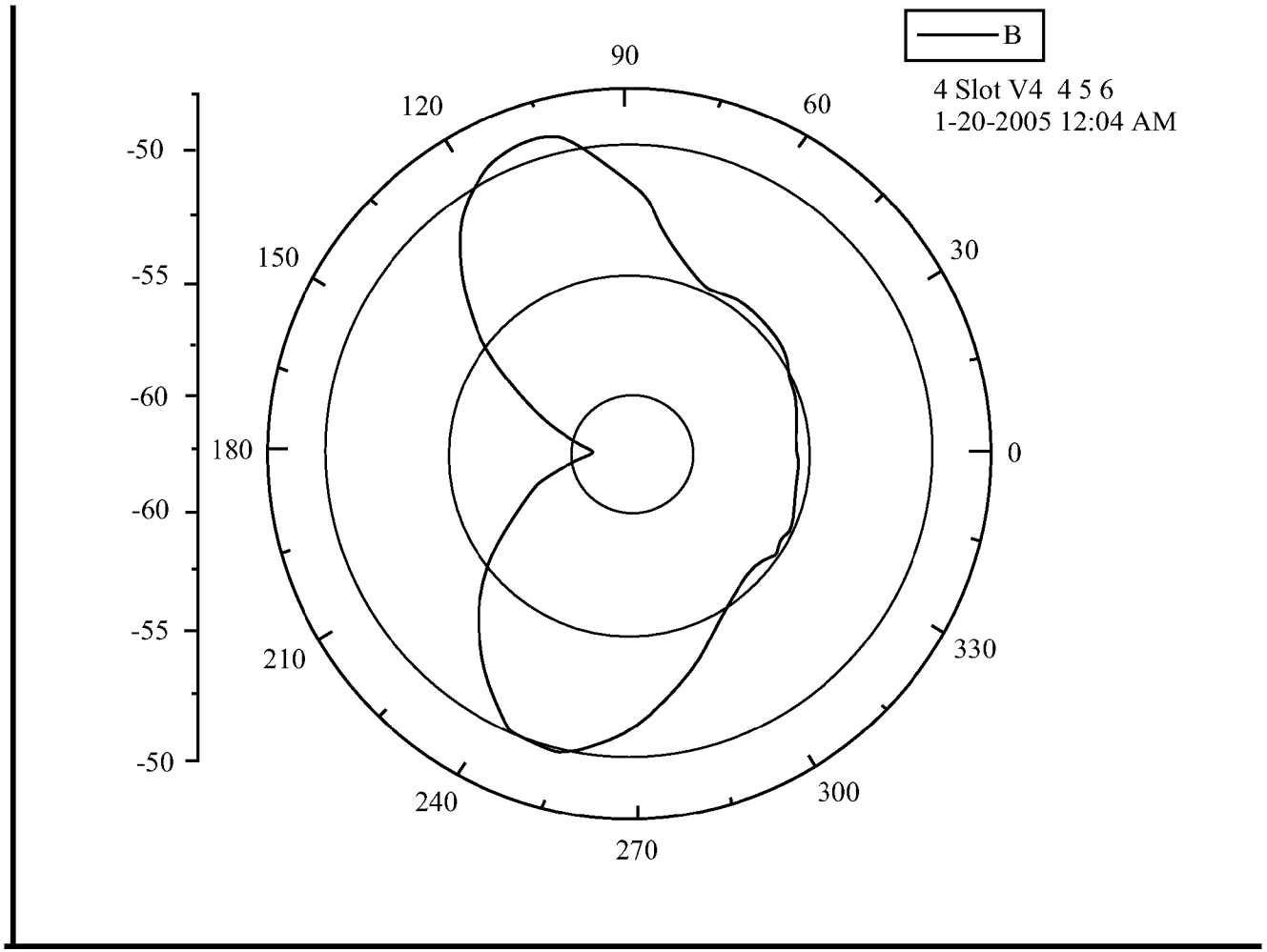

FIGS. 5A-5D show exemplary signal distribution plots in various directions based on selections of different lobes in accordance with a preferred embodiment. The pads illustrated in FIG. 4 are labeled one through six, or pads #1, #2, #3, #4, #5 and #6. The signal distribution plots were generated based on selectively turning on certain of pads #1-#6. FIG. 5A illustrates a signal distribution of the antenna when only pad #1 is selected. FIG. 5B illustrates a signal distribution of the antenna when pads #1, #2 and #3 are each selected. FIG. 5C illustrates a signal distribution of the antenna when only pad #4 is selected. FIG. 5D illustrates a signal distribution of the antenna when pads #4, #5 and #6 are each selected.

Figure 6:
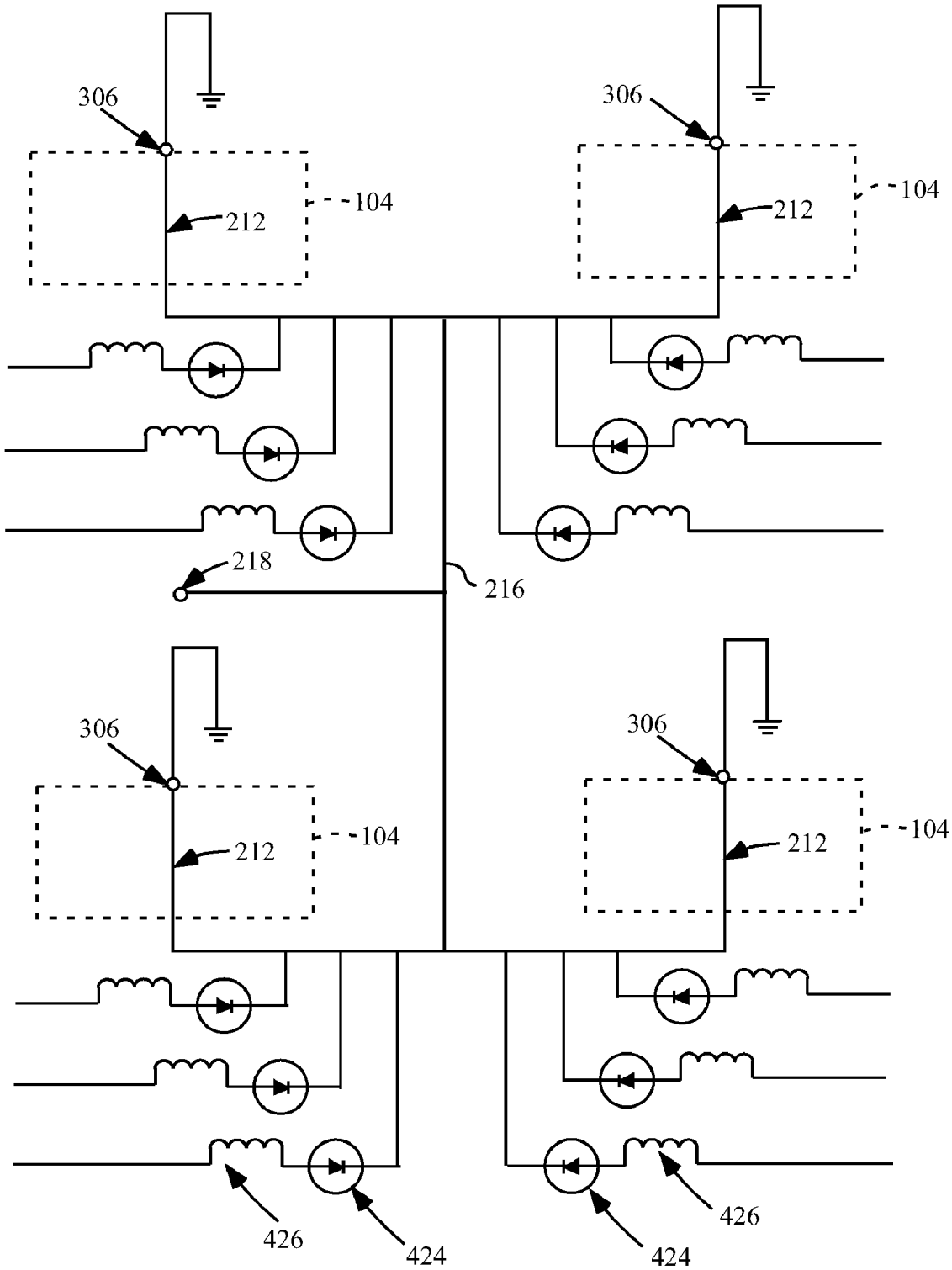
FIG. 6 schematically illustrates an electronic component representations of elements of a phased array antenna in accordance with a preferred embodiment.

FIG. 6 schematically illustrates an electronic component representations of elements of a phased array antenna in accordance with a preferred embodiment. The slots 104, microstrip feed lines 212, main feed line 216, coax attachment point 218 and microstrip feed line attachments points 306 are each shown and are preferably as described above. The microstrip feed line attachment points 306 are preferably grounded as illustrated in FIG. 6. The pin diode pads 424 and inductors 426 are illustrated with their common electrical representations.

Figure 7:
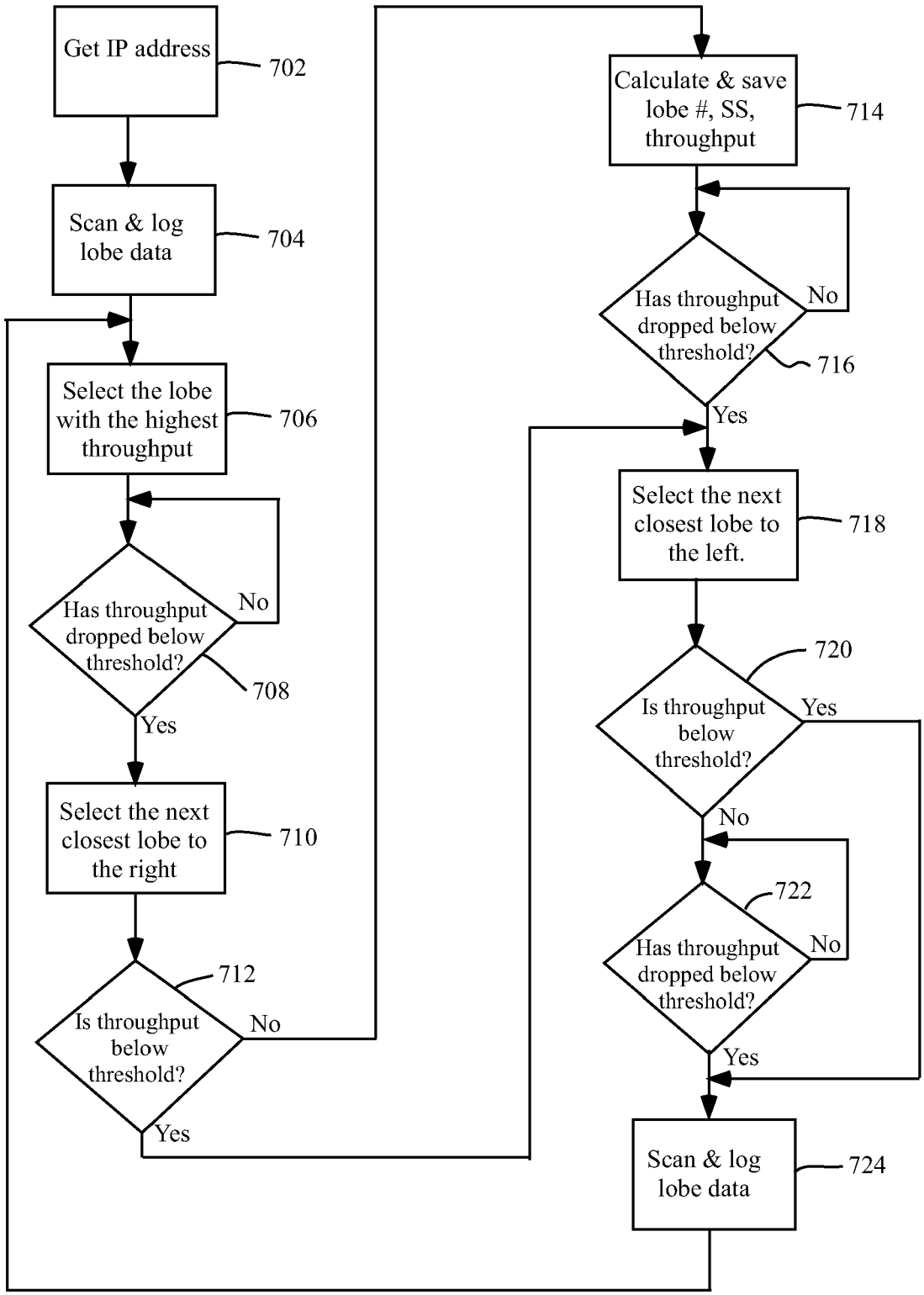
FIGS. 7-8 are a flow diagram of operations performed for selecting a signal distribution lobe of a phased array antenna in accordance with a preferred embodiment.
Figure 8:
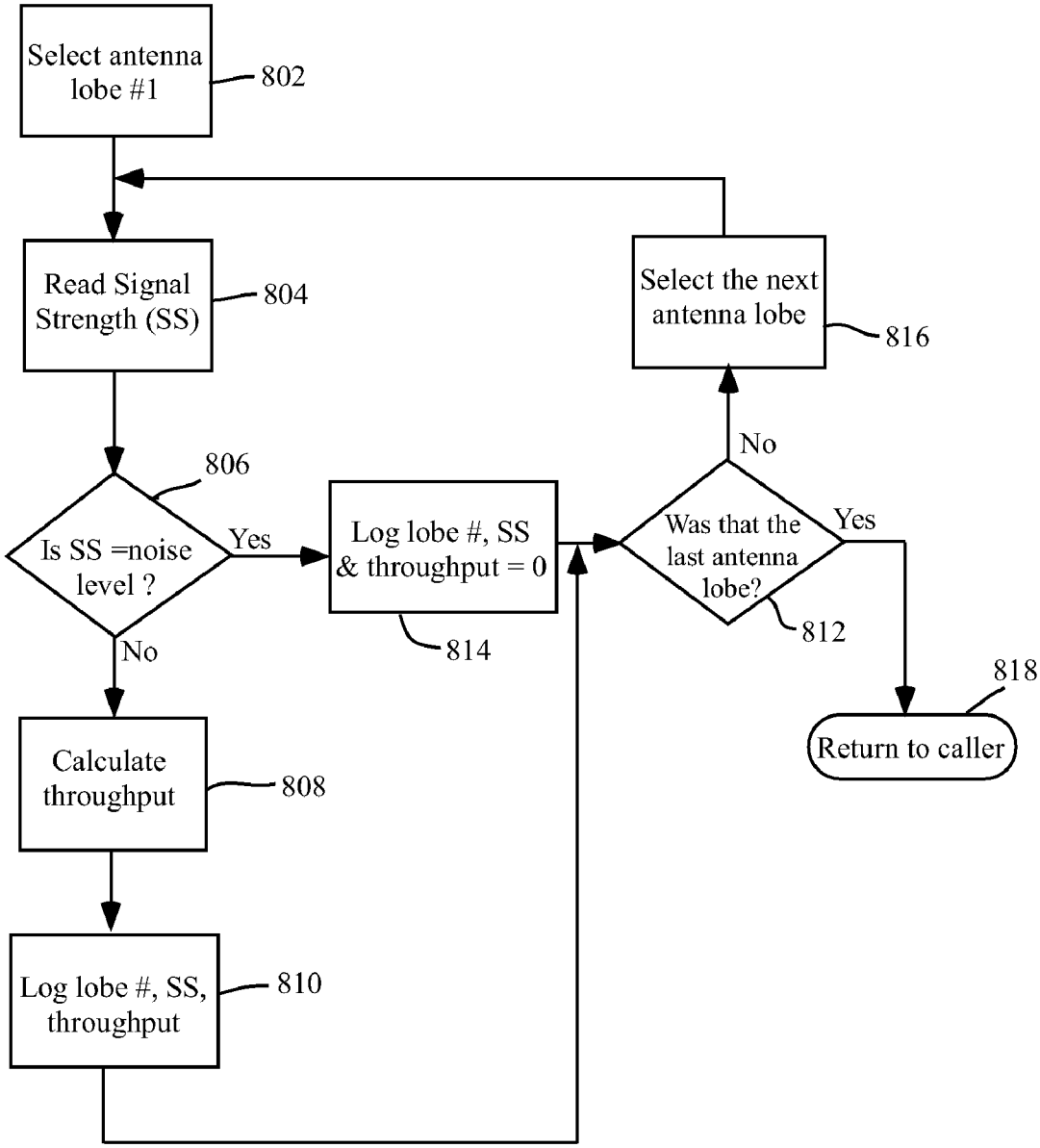

FIGS. 7-8 are a flow diagram of operations performed for selecting signal distribution lobes based on monitoring the throughput of lobes of a phased array antenna in accordance with a preferred embodiment. Although two lobes or more than three lobes may be available, the example process of FIG. 7 assumes three lobes for illustration. At 702, the IP address of a connected wireless device is obtained. The lobe data is scanned and logged for this connection to the antenna. Of the lobes that may be selected, the lobe with the highest throughput is selected. Throughput is the speed at which a wireless network processes data end to end per unit time. Typically measured in mega bits per second (Mbps). In this example, it will be assumed the middle of three lobes is selected.

This lobe is maintained as the selected lobe as long as the throughput remains above a threshold level. The threshold level may be a predetermined throughput level, or a predetermined throughput or percentage of throughput below a maximum, average or pre-set throughput level, or may be based on a comparison with other throughputs. At FIG. 8, which will be described in detail further below, if a signal strength falls to a noise level or within a certain amount of percentage of a noise level, then this fallen signal strength is used to determine when to select another lobe. The throughput is monitored according to the process of FIG. 7 continuously or periodically at 708. The process remains at 708 performing this monitoring unless it is determined that the throughput has dropped below the threshold level. Then at 710 another is lobe is selected such as the next closest lobe to the right. It is determined at 712 whether the throughput with this lobe is above or below the threshold. If the throughput with this new lobe is above the threshold, then the process moves to 714. At 714, the lobe number and signal strength of the new lobe and/or other data are saved. Now, the monitoring at 716 will go on with the new lobe as it did at 708 with the initial lobe. That is, the process will periodically or continuously monitor the throughput of the connection with the new lobe. The process moves to 718 only when the throughput with the new lobe is determined at 716 to be below the threshold level. Referring back to 712, if the throughput with the new lobe is determined there to be below the threshold, then the process moves directly to 718. At 718, yet another lobe, a third lobe, is selected such as the closest lobe to the left of the initial lobe. It is determined at 720 whether the throughput is above or below the threshold. If it is above the threshold, then this lobe will remain the selected lobe unless and until the throughput falls below the threshold. If the throughput does drop below the threshold, then at 724 lobe data is scanned and logged, and the process returns to 706 to select the highest throughput lobe again.

The process at FIG. 8 illustrates monitoring of the signal strengths and other data of all of the lobes according to a further embodiment, e.g., to select the strongest lobe. Referring now to FIG. 8, lobe #1, e.g., is selected at 802. The signal strength of the connection of a wireless device is read at 804. If the signal strength is determined to be above a noise level, or alternatively if the signal strength is above some predetermined amount or percentage above the noise level, then the throughput is calculated at 808. The lobe number, signal strength and throughput are logged at 810 and the process moves to 812. If at 806, the signal strength is determined to be at a noise level or at or below a predetermined amount or percentage above the noise level, then the lobe number, signal strength and throughput (equal to 0) are logged at 814 and the process moves to 814.

At 812, it is determined whether the data regarding the last lobe has been processed. If it has not, then the process returns to 804 to perform the monitoring for the next lobe. If the lobe data for all of the lobes has been monitored and determined, then the process returns to caller at 818.

Some of the features disclosed at parent U.S. application Ser. Nos. 11/055,490 and/or 60/617,609, which are hereby incorporated by reference, are summarized as follows. A high gain, phased array antenna includes a conducting sheet having a number of one or more slots defined therein, and for each of the slots, an electrical microstrip feed line disposed within a parallel plane to the slot. The microstrip feed lines and corresponding slots form magnetically coupled LC resonance elements. A main feed line couples with the microstrip feed lines.

The slots may have an oblong shape, e.g., a rectangular or elliptical shape. The microstrip feed lines may extend in preferably the short or alternatively the long dimensions of the oblong slots. The main feed line may couple with a coax cable attachment. The slots may be fed in parallel by the microstrip feed lines.

The number of slots may be two or four, and wherein one or two slots, respectively, may be disposed on each side of the main feed line which is center fed with a coax cable attachment, thereby providing two halves of the main feed line. In this embodiment, each half of the main feed line may have the same resistance, which may be also the same total resistance as the parallel combination of the microstrip feed lines that correspond to that half of the main feed line. The input impedance of the antenna may be selected to be the same resistance as the halves of the main feed line. The antenna signal may include one or more discreet lobes extending away from the antenna.

There may be only a single slot which is fed with a coax cable attachment. In this case, the input impedance of the antenna may be selected to be the same as the coax impedance. The antenna signal in this case may also include one or more discreet lobes extending away from the antenna.

There may be only a single slot which is fed with a microstrip feed line. In this case, the input impedance of the antenna may be selected to be the same as the microstrip feed line. The antenna signal in this case may also include one or more discreet lobes extending away from the antenna.

A further high gain, steerable phased array antenna includes a board or conducting sheet having multiple slots. For each of the slots, an electrical microstrip feed line is disposed within a parallel plane to the slot. The microstrip feed lines and corresponding slots form magnetically coupled LC resonance elements. A main feed line couples with the microstrip feed lines. Delay circuitry is used to electronically steer the antenna by selectively changing signal phases on the microstrip feed lines. One or more processors operating based on program code continuously or periodically determine a preferred signal direction and control the delay circuitry to steer the antenna in the preferred direction. Preferably the slots are oblong or rectangular. The microstrip feed lines preferably extend in the short dimensions of the slots.

A method of operating a high gain, steerable phased array antenna is also provided. The method includes electronically steering the above-described antenna by controlling the delay circuitry, continuously or periodically determining a preferred signal direction, and controlling the delay circuitry to selectively change signal phases on the microstrip feed lines and thereby steer the antenna in the preferred direction.

A further high gain, steerable phased array antenna is also provided, along with a corresponding method of operating it. The antenna includes multiple resonant elements and a main feed coupling with the resonant elements. Electronics are used for steering the antenna by providing different inputs to the resonant elements. One or more processors operating based on program code continuously or periodically determine a preferred signal direction based on a directional throughput determination, and control the electronics to steer the antenna in the preferred direction. The resonant elements are preferably oblong or rectangular slots defined in a board.

The antenna signal preferably includes multiple discreet lobes extending in different directions away from the antenna. The lobes are preferably selected by controlling the electronics based on the directional throughput determination.

The directional throughput determination may include monitoring the throughput of an initial selected lobe, and when the throughput drops below a threshold value, or drops a predetermined percentage amount, or becomes a predetermined amount above a noise level, or combinations thereof, then changing to an adjacent lobe and similarly monitoring its throughput. When the adjacent lobe is determined to have a throughput that is below a threshold value, or is at least a predetermined percentage amount below a maximum value, or is below a predetermined amount above a noise level, or combinations thereof, then the selected lobe is changed to the other adjacent lobe on the opposite side of the initial selected lobe. The directional throughput determination may also include scanning through and determining the throughputs of all or multiple ones of the lobes, wherein the lobe with the highest throughput is selected.

One or more processor readable storage devices are also provided having processor readable code embodied thereon. The processor readable code programs one or more processors to perform any of the methods of operating a high gain steerable phased array antenna described herein.

Reference is made in what follows to new FIGS. 9-17. These new features may be advantageously utilized in combination with or in lieu of features already described with reference to FIGS. 1-8 which are disclosed in the parent U.S. patent application Ser. Nos. 11/055,490 and/or 60/617,609, which are incorporated by reference.

Microstrip feed lines 212 are described above with reference to FIGS. 2, 3, 4 and 6. These provide a precision resonance frequency. In an embodiment, that frequency is around 2.4 GHz. The resistance is around 100 ohms which provides a certain q-factor depending on the reactance. In another embodiment, a broader band is provided such as a 200 MHz or 400 MHz wide band between 2.3 GHz-2.5 GHz or 2.3 GHz-2.7 GHz, respectively, 500 Mhz wide band between 3.3 GHz-3.8 GHz, 1 Mhz wide band between 4.9 GHz to 5.9 GHz, 1.32 Ghz wide band between 3.168 Ghz to 4.488 Ghz. This may be achieved by enhancing the q-factor by reducing the resistance, e.g., to around 50 to 80 ohms. The new resistance is matched at the drive end.

Figure 9:
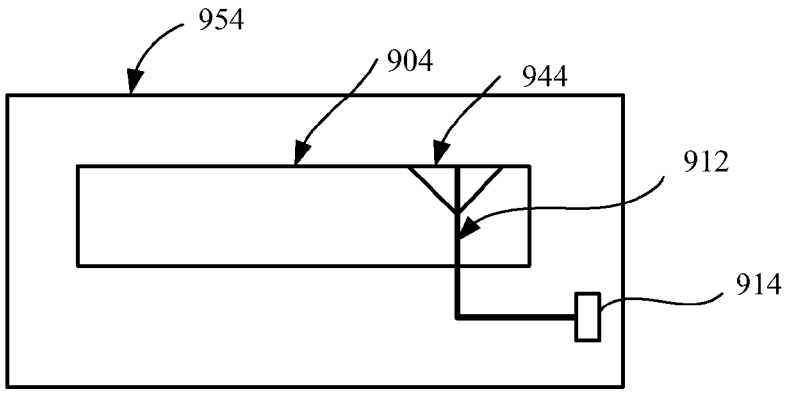
FIG. 9 schematically illustrates a LC resonant slot with an off-center microstrip feed line.

Different microstrip feed lines may be provided to achieve reduced resistance and enhanced q-factor. The microstrip feed lines may be provided across the centers of the slots producing a half-wave $\lambda/2$ resonance condition as already described, and the feed lines may be alternatively provided at the ends of slots producing a quarter-wave $\lambda/4$ condition, as illustrated at FIG. 9, which illustrates a slot 904 having a microstrip feed line 912 which is disposed across the slot 904 about a third to an eighth of the way from one of the long sides, or as shown, e.g., a sixth of the length of a long side from one of the short sides. Associated electronic circuitry components are represented by block 914, and a triangle 944 is provided on the printed circuit board 954. Other "off-center" positioning of the microstrip feeds lines may be utilized such as a quarter or a fifth of the length of a long side from one of the short sides, and the feed line 912 may cross at an angle to either side.

Figure 10A:
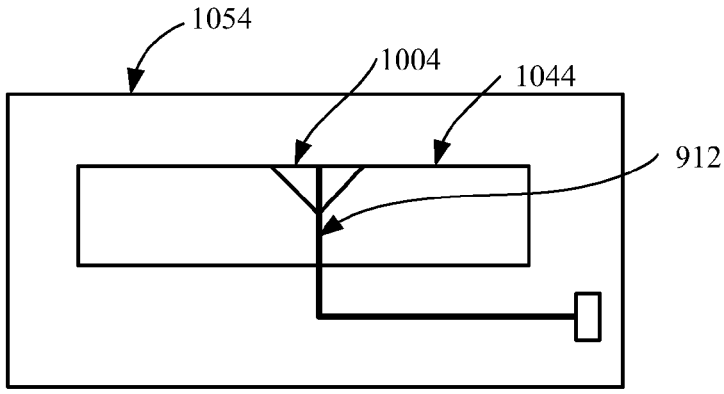
FIG. 10*a* schematically illustrates a LC resonant slot with a microstrip feed line that has been widened in accordance with an embodiment.

The trace may also be widened as illustrated by the wide microstrip feed line 1012 of the slot 1004 illustrated schematically at FIG. 10*a*, compared, e.g., with those illustrated at FIG. 2, 3, 4 or 6. A similar triangle 1044 is provided on the printed circuit board 1054 as triangle 944 of FIG. 9.

Figure 10B:
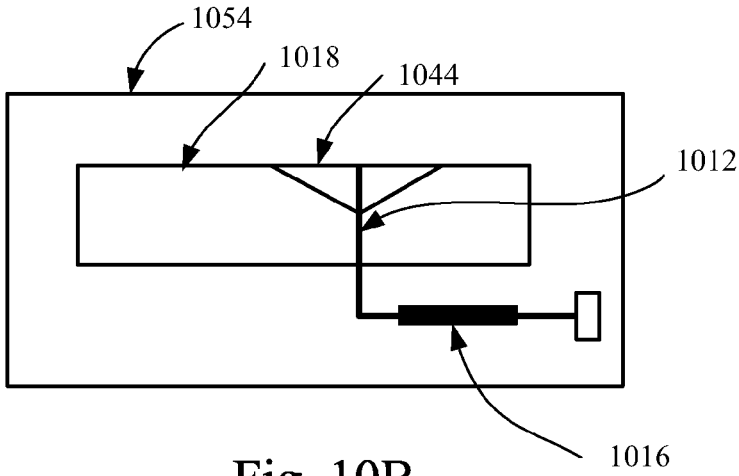
FIG. 10*b* schematically illustrates a LC resonant slot with a microstrip feed line having multiple layers of traces of different widths in accordance with another embodiment.
Figure 10C:
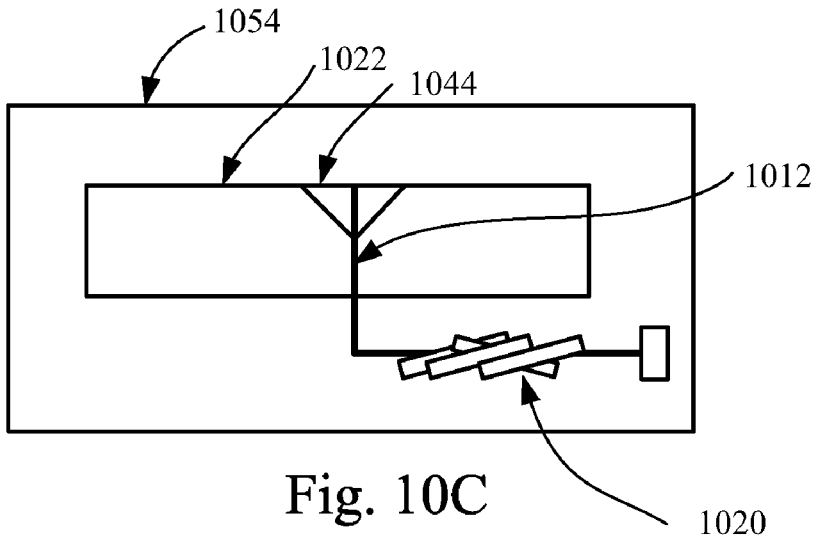
FIG. 10*c* schematically illustrates a LC resonant slot with a microstrip feed line having a segment with various traces of various widths applied in various directions over various segment portions in accordance with certain embodiments.

In another embodiment, multiple layers of traces 1012, 1016 of different widths are provided for the slot 1018 illustrated at FIG. 10*b*. The first trace may be the microstrip feed line of FIG. 10*a*. The second trace 1016, which is wider than the first trace 1012, may be applied over the first trace 1012 at a localized segment of the overall trace 1012. The wider second trace 1016 may be applied over a larger or shorter length segment, and multiple wider or narrower traces may be applied over multiple segments of the overall trace 1012. That is, various traces of different widths and lengths may be provided. With respect to the slot 1022 illustrated at FIG. 10*c*, multiple wide traces 1020 are applied over a short segment of the overall trace 1012 in different directions and overlapping slightly different segment portions. Traps may be created. A trace may be created which changes its width from one end to another, or that merely has one or more selected segments with a different width than other segments. The segments of different width may have constant width or changing width. Multiple traces may be provided for a single slot having various widths and/or lengths.

Figure 11:
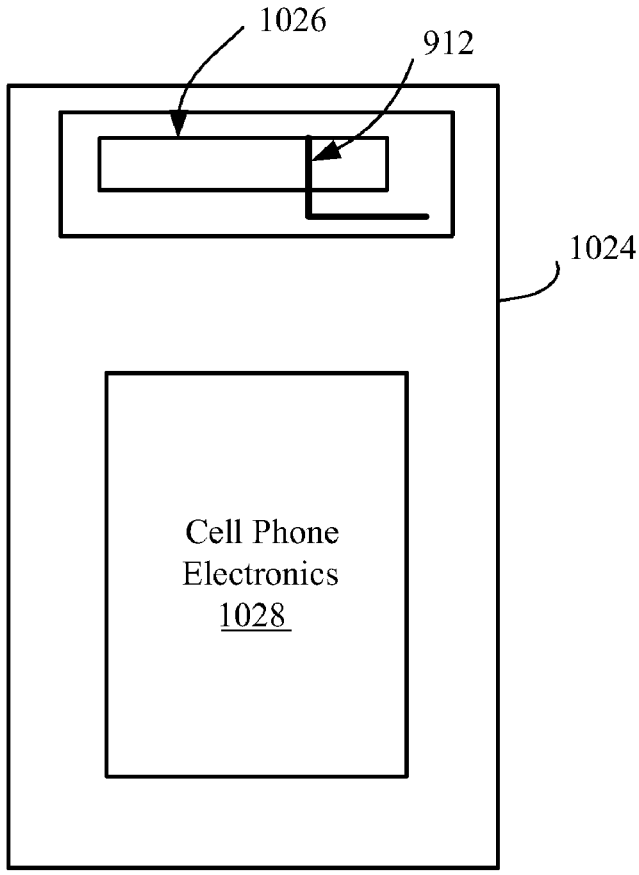
FIG. 11 schematically illustrates a cell phone with a LC resonant slot in accordance with an embodiment.

A mobile phone 1024 is provided as illustrated at FIG. 11, with one or more slots 1026 of approximate dimensions one inch by two and a half inches, or 1"×2.5". An off-center microstrip feed line 912 is illustrated, but multiple different configurations may be used. The slot 1026 and feed line 912 are shown in FIG. 11 proximate to but displaced from other cell phone electronics 1028.

A slot may be one inch wide at its narrowest and six inches long, as another example, and the width may change over its six inch length (or whatever length it has).

Figure 12A:
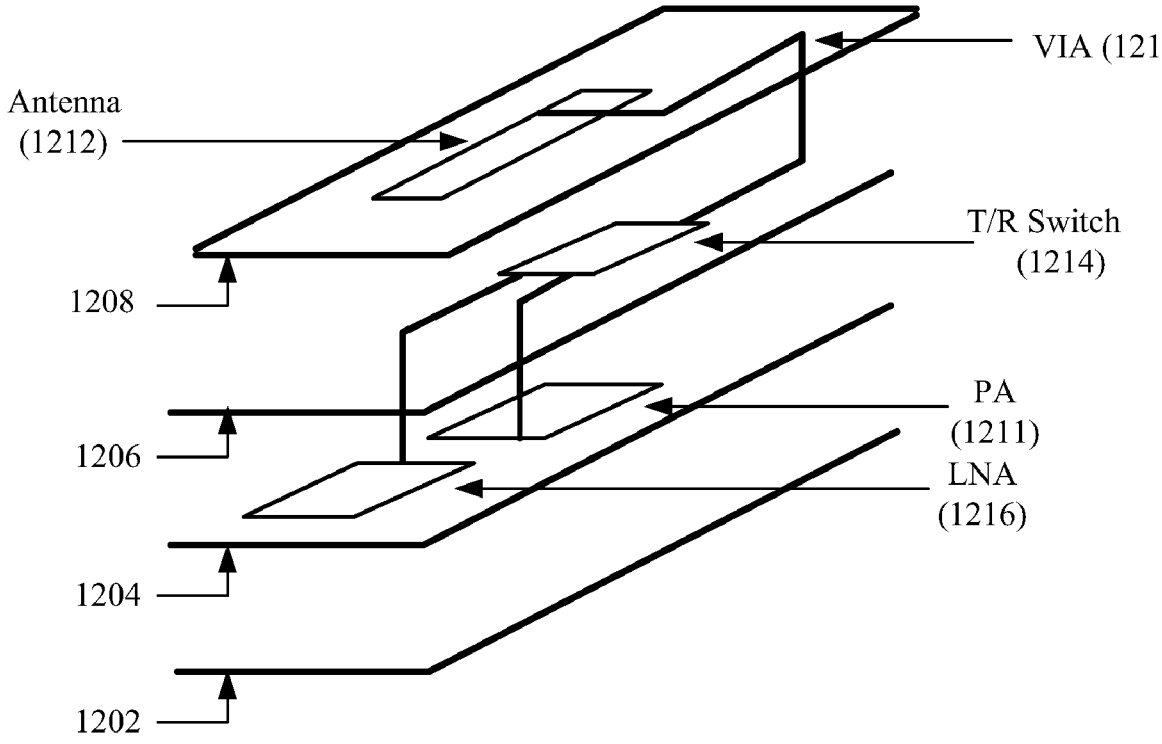
FIG. 12*a* schematically illustrates an IC antenna in accordance with an embodiment.
Figure 12B:
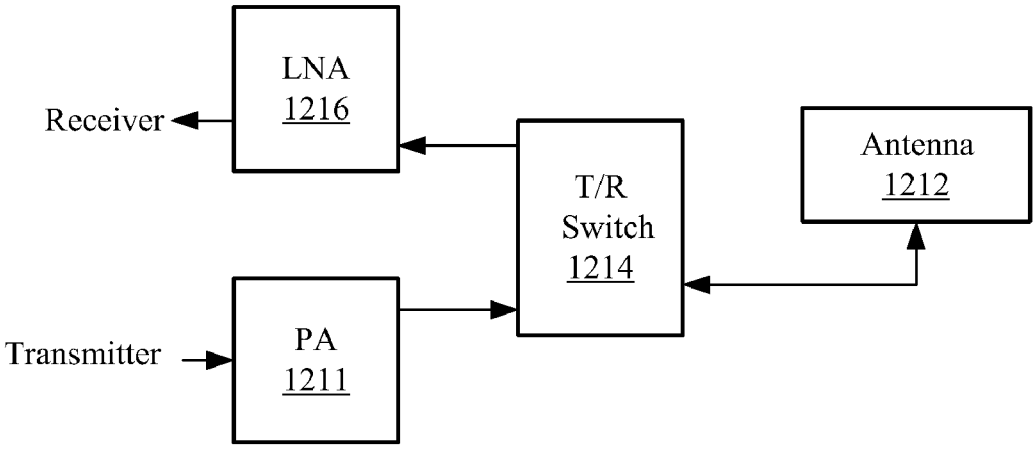
FIG. 12*b* illustrates components of the IC antenna of FIG. 12*a*.

An IC is also provided with a current drive slot in the top layer, as illustrated at FIG. 12*a*. The IC may be packaged as a Flip Chip or any other IC packaging. Four layers 1202, 1204, 1206 and 1208 are illustrated at FIG. 12*a*. A via 1210 is provided in the top layer 1208 to a power amplifier 1211 in the third layer down 1204 that may be up to 20 dB. The antenna 1212 is also found at the top layer 1208. Capacitance is provided internally or externally. In this way, the frequency can be easily tuned. Batches of these may be provided in an IC, wherein a line-up configuration of ten of these slots 1212 may reduce powerline requirements by a factor of 10. Logical devices in each IC can be a Transmit/Receive Switch, or T/R Switch 1214, Low Noise Amplifier, or LNA 1216, and a Power Amplifier, or PA 1211. These components, i.e., antenna 1212, T/R switch 1214, power amplifier 1211, and low noise amplifier 1216 are also illustrated in block form at FIG. 12*b*.

FIGS. 13*a*-13*f* illustrate different shapes for slots that provide further functionalities. For many of the following examples, the shape can be considered a single slot having the shape illustrated, or two of more slots overlapping or spaced-apart in a way that the combination produces the radio frequency characteristic of the antenna that is sought to be achieved. For example, a criss-cross shape is illustrated by the slot 1304 and feed line 1312 of FIG. 13*a*, wherein the feed line 1312 may also cross in a variety of other ways. An x-shape slot 1314 is illustrated with feed line 1322 in FIG. 13*b*. Other configurations of overlapping oblong slots may also be provided, such as T, V, or L configurations, or any other letter of the alphabet, or other combination of straight and/or curved segments. Additional 3 dB gain may still be achieved for every double number.

These can be used also to enhance antenna directionality. These may be cross-polarized with regard to the bandwidth. A dimension may be 2.5 octaves, such that 1 mm provides 10 GHz and 2.5 mm provides 1 GHz.

Figure 13A:
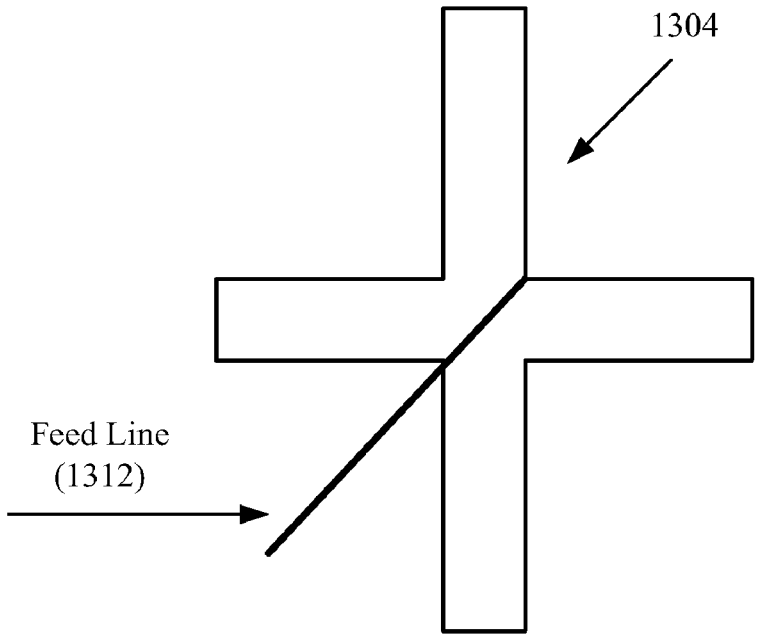
FIGS. 13*a*-13*g* illustrate different shapes for slots with different functionalities in accordance with further embodiments.
Figure 13B:
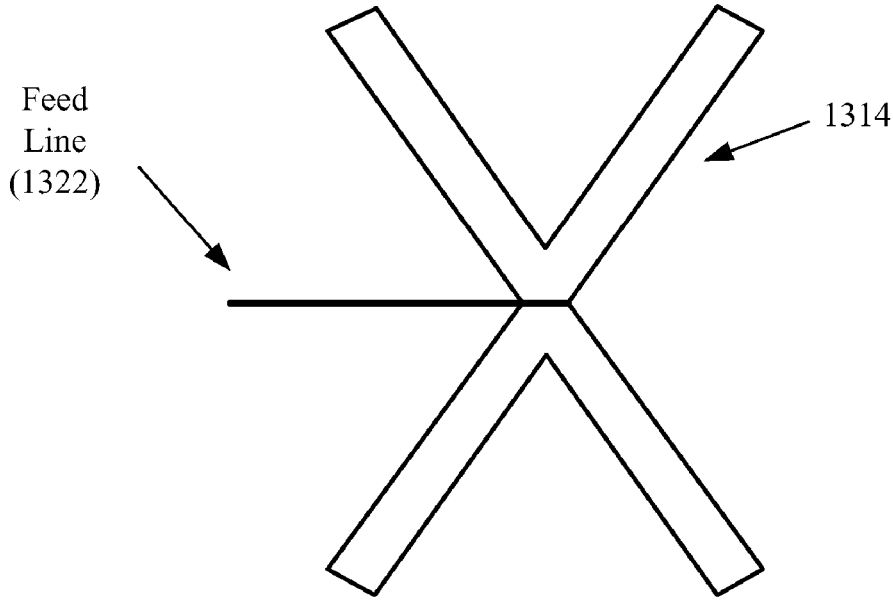
Figure 13C:
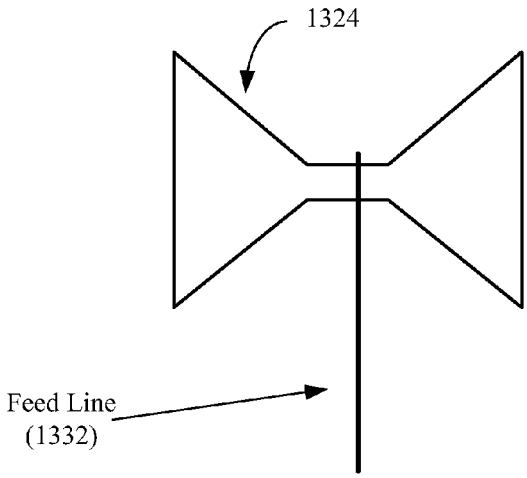
Figure 13D:
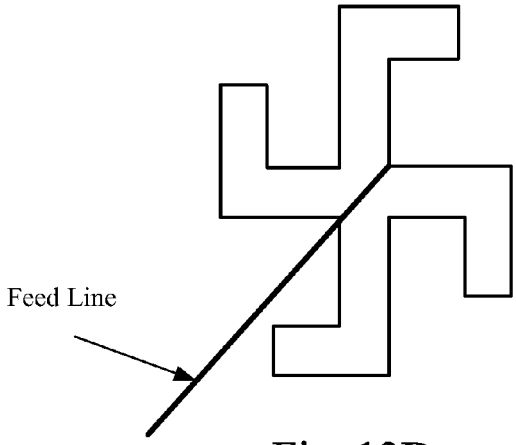
Figure 13G:
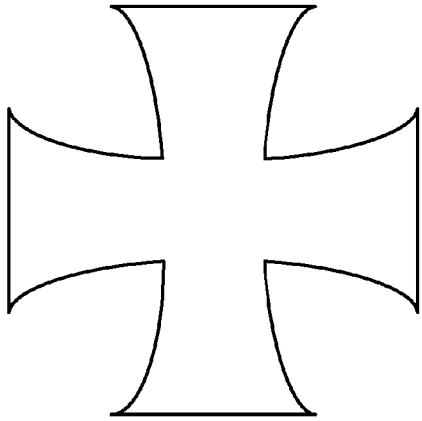
Figure 13E:
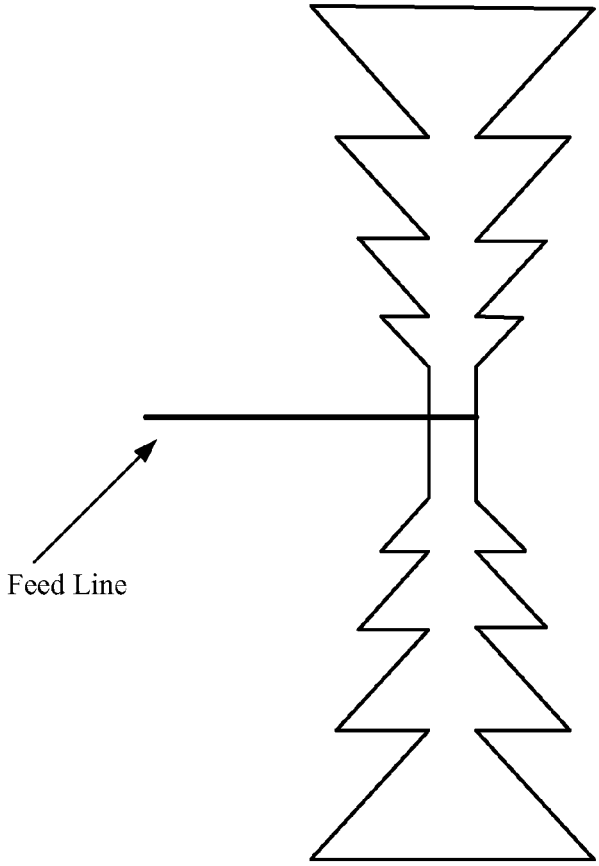
Figure 13F:
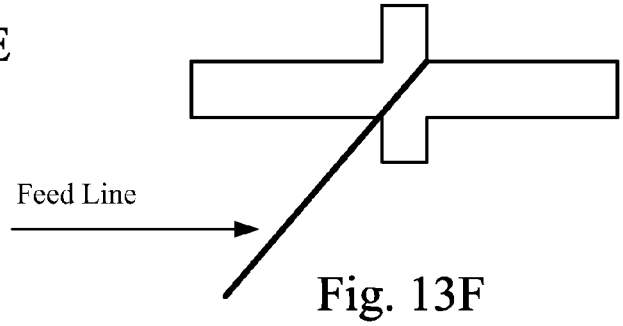

A slot 1324 may be bowtie-shaped as shown with feed line 1332 in FIG. 13*c*, wherein the bowtie may be orientated in any direction. A hook-cross or swastika shape, or Christmas tree shape, or oblong slot with protrusion, or iron cross shape, as illustrated in FIGS. 13*d*, 13*e*, 13*f* and 13*g*, respectively, are provided in alternative embodiments.

Such configurations provide optimally 360° steering flexibility and azimuth. This may be provided with the delay pads that were described above, or may be provided in lieu of the delay pads. The antenna may be steered based on any or all of throughput, strength and signal-to-noise ratio.

Figure 14:
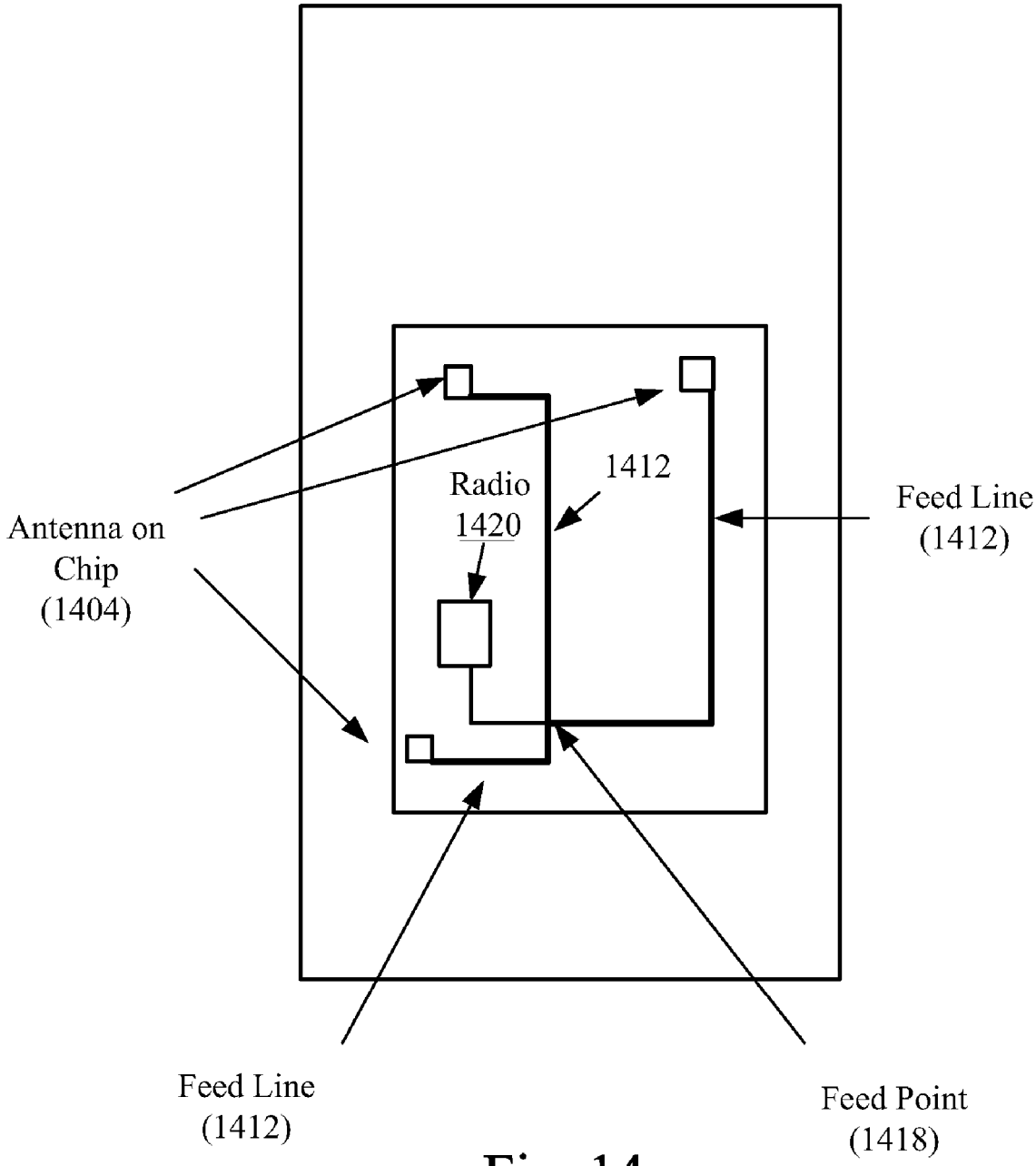
FIG. 14 schematically illustrates an embodiment of an antenna that includes multiple slots and utilizes interferometry principles.

Interferometry principles may also be applied as illustrated at FIG. 14. That is, gains from slots having a same frequency and phase can be added. Two or more slots are used, with each slot working as a point source. Three slots 1404 are shown in FIG. 14, each having its own feed line 1412. The three feed lines connect at a common feed point 1418 and the radio 1420 in the embodiment of FIG. 14. Each slot receives a different signal from a single source. The different signals are combined to show a three-dimensional picture of the single source.

Figure 15:
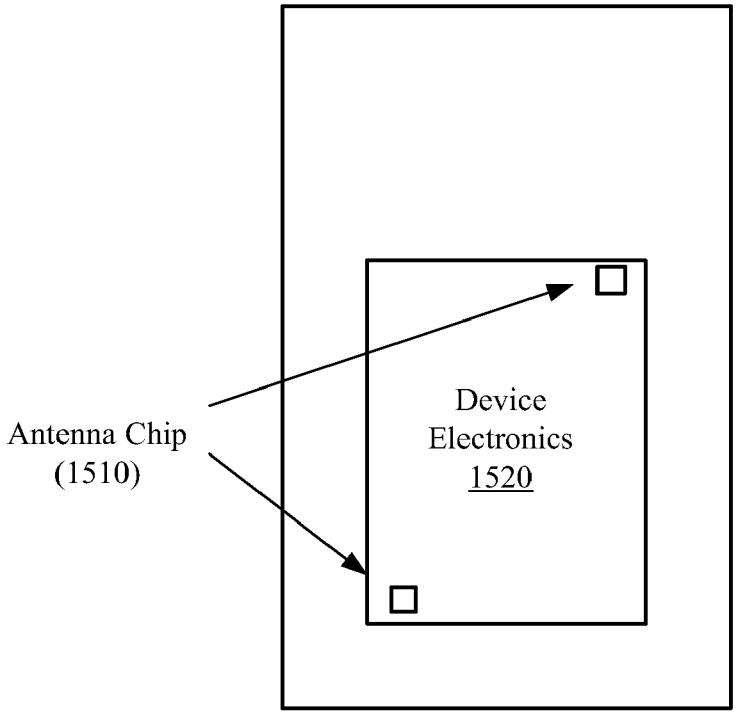
FIG. 15 schematically illustrates a circuit board with two chips in accordance with another embodiment.

A circuit board may be provided as illustrated at FIG. 15. Two chips 1510, i.e., IC's packaged or as flip chips, may be provided at corners of a circuit board that includes other device electronics 1520. The spacing of the two chips can be of any distance.

Figure 16:
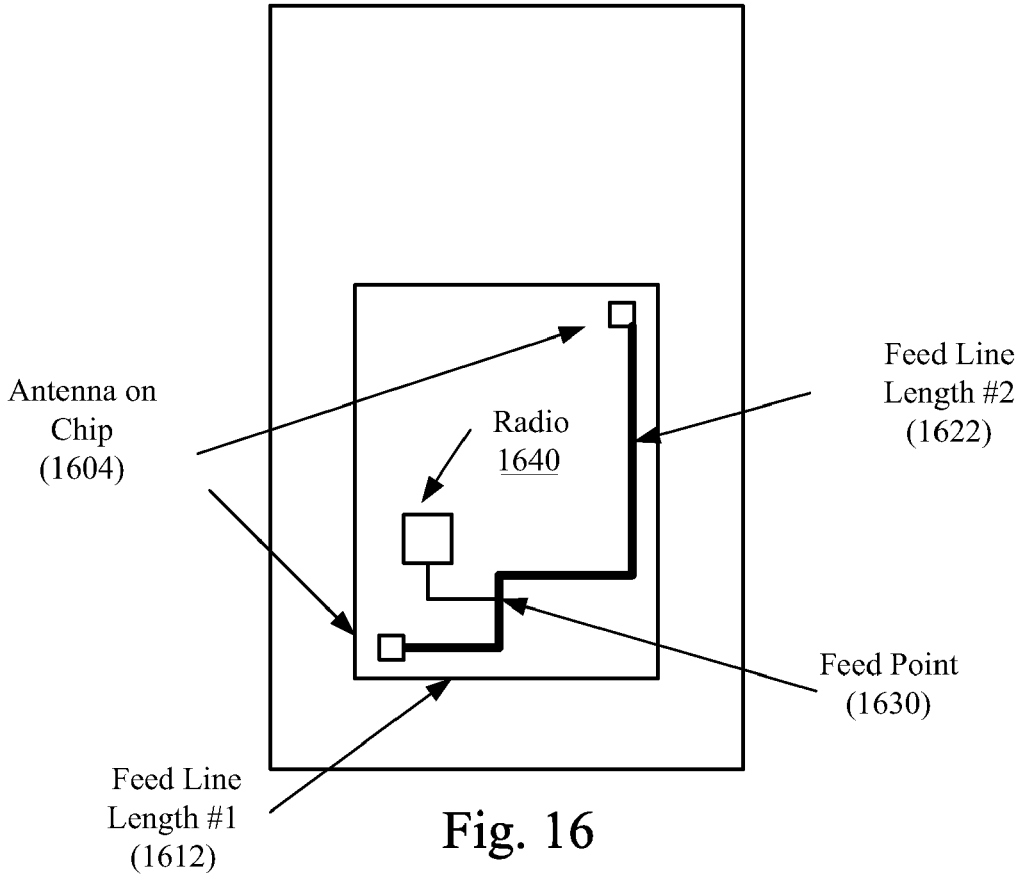
FIG. 16 schematically illustrates a synthetic aperture in accordance with an embodiment.

A synthetic aperture may also be provided as illustrated at FIG. 16 which shows radio 1640. Two or more slots 1604 having the same frequency are controlled by different length feed lines 1612 and 1622 emanating from a feed point 1630. The length of the feed lines corresponds to the spacing between the slots so that the slots intercept the signal at pre-defined points. This method is used when the wavelength of the incoming signal is longer than the slot antenna. Two small slots are used to appear as one longer slot of larger aperture, forming a synthetic aperture.

Figure 17:
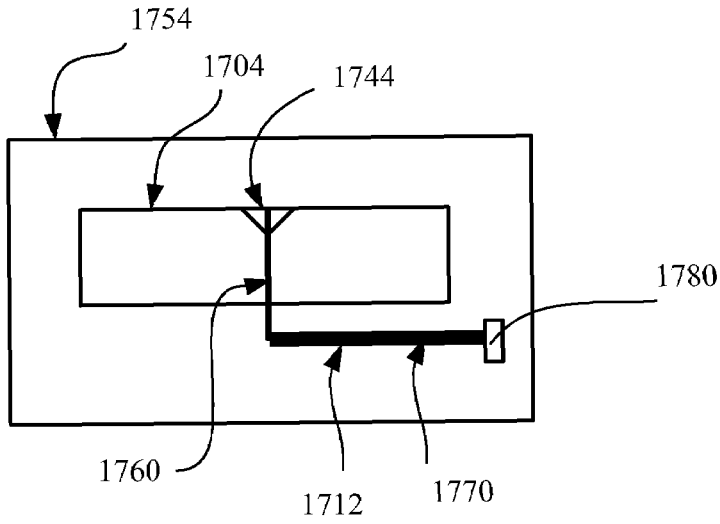
FIG. 17 schematically illustrates an ultra wideband performance antenna in accordance with a further embodiment.

Ultra wideband performance may also be achieved as illustrated by the slot 1704 and feed line 1712 of FIG. 17. First, the Q is loaded by decreasing the amount of capacitance on the feed line 1712 at the slot 1704. This is achieved by decreasing the size of the triangle 1744 on the back side of the PCB 1754. Second, the impedance of the feed line segment 1760 that crosses the slot is less than 100 ohms. Then, the feed line 1712 transitions to a wider segment 1770 that has an impedance of 50 ohms to the source 1780.

Figure 18:
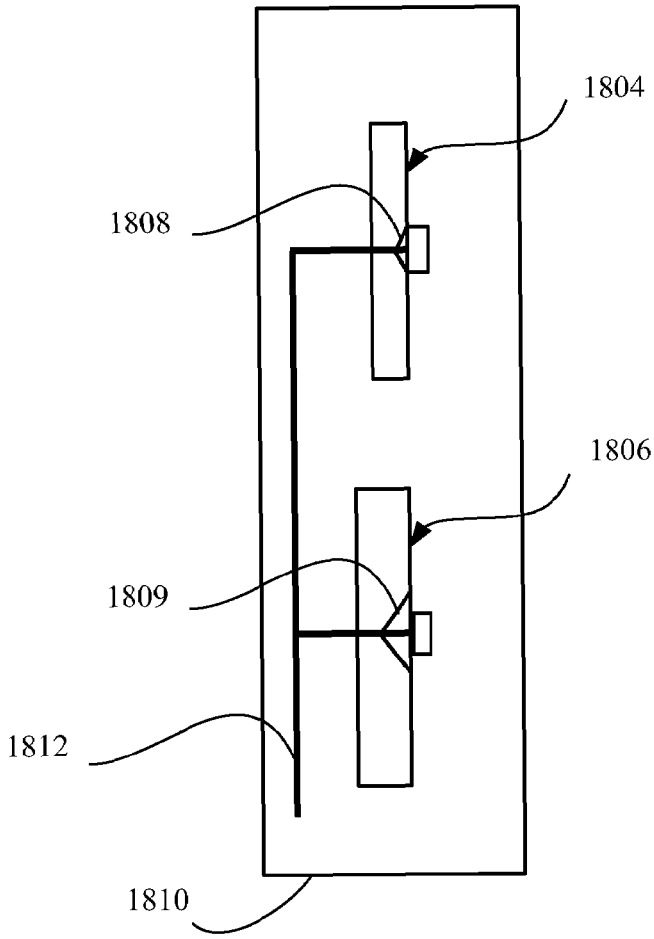
FIG. 18 schematically illustrates an antenna with enhanced ultra wideband and dual band performance in accordance with another embodiment.

Enhanced ultra wideband and dual band performance is achieved as illustrated in FIG. 18. Two ultra wideband slot antennas 1804 and 1806, or one standard antenna 1806 and one wideband antenna 1804, with smaller triangle 1808 and dimensions than the triangle 1809 and dimensions of the standard antenna 1806, are placed on a common substrate 1810 and fed by a common feed line 1812. The slots 1804 and 1806 resonate at different frequencies. The bandwidth and center frequency of each slot can be adjusted so that the frequency spectrum of the two slot antennas overlaps. The bandwidth and center frequency of each slot can also be adjusted for different bands where the frequency spectrum does not overlap.

Figure 19A:
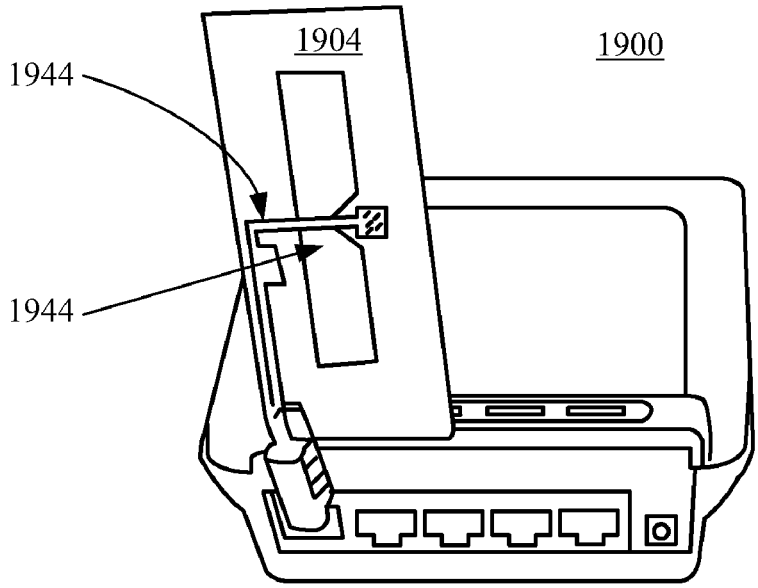
FIG. 19A shows a microstrip view of an antenna in accordance with a preferred embodiment.
Figure 19B:
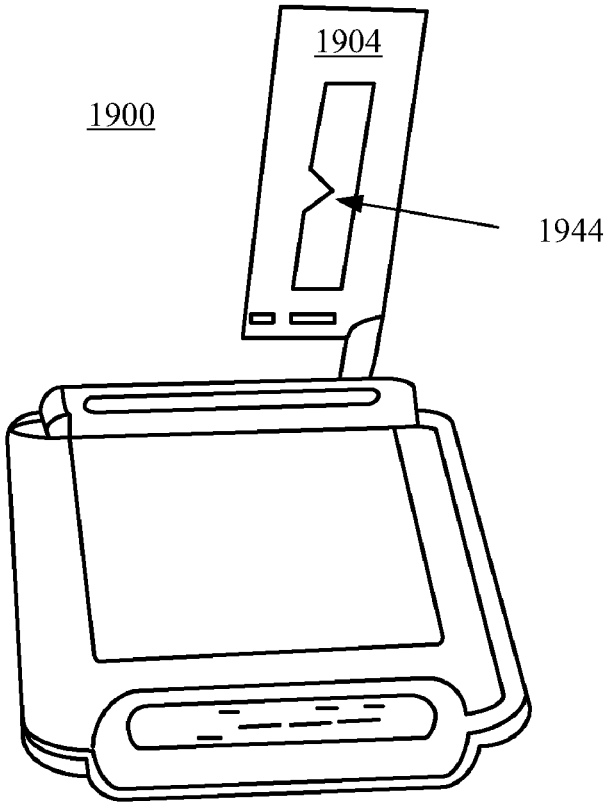
FIG. 19B shows a slot view or opposite side view of the antenna of FIG. 19B.

Referring now to FIGS. 19A-19B, the antenna 1900 is preferably formed of two or more layers in certain embodiments. The materials may be printed circuit board materials. The microstrip feed line 1912 may be formed on the top layer and the bottom layer may contain a slot 1904 and triangle 1944 (see also, e.g., slot 904 and triangle 944 of FIG. 9, and slot 1004 and triangle 1044 of FIG. 10*a*, et seq.). The microstrip feed line 1912 (see also elements 912 and 1012 of FIGS. 9 and 10*a*, et seq.) preferably interacts with a 2nd layer, separated by a distance and a dielectric material.

FIG. 19A illustrates a view of the antenna 1900 from the microstrip side, while FIG. 19B illustrates a view of the antenna 1900 from the opposite side, or the slot side.

The antenna 1900 may also be built on a four layer PCB. In the four layer embodiment, layers one and four are referred to as the top and bottom layers, respectively, while layers two and three are empty or contain no copper (or similar conductor).

FR4 may be used, as well as RO-3010 and RO-4350B of the Rogers Corporation (see www.rogerscorporation.com, which is hereby incorporated by reference, and particularly the sections regarding the RO4000 and RO3000 series high frequency circuit materials). Different dielectric materials may be used that permit the antenna to exhibit enhanced performance with a lower loss-tangent and higher gain.

The antenna may also be selectively-sized to be larger or smaller than illustrated or described above. For example, the dimensions of the antenna may be shrunk. By using a higher dielectric constant (e.g., that of RO-3010 is higher than typical) actually facilitates the shrinking. Two or four layer embodiments are preferred with these materials.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

In addition, in methods that may be performed according to preferred embodiments and that may have been described above, and/or as recited in the claims below, the operations have been described above and/or recited below in selected typographical sequences. However, the sequences have been selected and so ordered for typographical convenience and are not intended to imply any particular order for performing the operations.

In addition, all references cited above herein, in addition to the background and summary of the invention sections, are hereby incorporated by reference into the detailed description of the preferred embodiments as disclosing alternative embodiments and components. The following are also incorporated by reference:

U.S. Pat. Nos. 3,705,283, 3,764,768, 5,025,264, 5,087,921, 5,119,107, 5,347,287, 6,611,231, 6,456,241, 6,388,621, 6,292,133, 6,285,337, 6,130,648, 5,189,433; and United States published patent applications nos. 2005/0146479, 2003/0184477, 2002/0171594, and 2002/0021255; and European published patent applications nos. EP 0 384 780 A2/A3, EP 0 384 777 A2/A3; and Brown et al., "A GPA Digital Phased Array Antenna and Receiver," Proceedings of IEEE Phased Array Symposium, Dana Point, Calif., May, 2000, 4 pages;

Agile Phased Array Antenna, by Roke Manor Research, 2002; and

Galdi, et al., "Cad of Coaxially End-Fed Waveguide Phased-Array Antennas", Microwave and Optical Technology Letters, Vol. 34, No. 4, Aug. 20, 2002, pp. 276-281.

What is claimed is:

1. A high gain, steerable phased array antenna, comprising:

(a) a conducting sheet having one or more slots defined therein, at least one of the slots having a triangular protrusion into the slot;

(b) for each of the slots, an electrical microstrip feed line coupled with the slot to form a magnetically coupled LC resonance element, the electrical microstrip feed line of at least one of the LC resonance elements being coupled with one of the triangular protrusions; and (c) a main feed line coupling with the microstrip feed lines;

(d) wherein at least one microstrip feed line includes at least one segment with greater width than other segments to reduce electrical resistance and produce an enhanced q-factor to provide a selected broader bandwidth for the antenna.

2. The antenna of claim 1, wherein said segment of greater width comprises an original feed line having the width of the other segments, and an additional trace over the original feed line.

3. The antenna of claim 1, wherein the microstrip feed line is electrically-connected to its corresponding slot.

4. The antenna of claim 1, wherein the microstrip feed line is coupled across its corresponding slot from one side to another.

5. The antenna of claim 1, wherein the microstrip feed line crosses said slot off-center.

6. The antenna of claim 1, wherein said segment with greater width has a rectangular shape.

7. A mobile phone device including the antenna of claim 1.

8. An IC antenna device including the antenna of claim 1.

9. The antenna of claim 1, wherein the one or more slots comprise at least two oblong slots that overlap in a criss-cross shape design.

10. The antenna of claim 1, wherein the one or more slots comprise at least two oblong slots that overlap in a X-shape design.

11. The antenna of claim 1, wherein the one or more slots comprise at least on slot having bowtie-shaped design.

12. The antenna of claim 1, wherein the one or more slots comprise at least two slots that overlap to in a hook-cross shape, iron-cross or Christmas tree-shape design, or combinations thereof.

13. The antenna of claim 1, wherein the one or more slots comprise at least two slots of different size or shape or both, and thus different resonant frequencies.

14. The antenna of claim 13, wherein the at least two slots overlap each other in a crossed design.

15. The antenna of claim 13, wherein the at least two slots provide dual band or enhanced ultra wide band capability, or both.

16. The antenna of claim 1, further comprising:

(e) delay circuitry for electronically steering the antenna by selectively changing signal phases on the microstrip feed line; and (f) one or more processors operating based on program code that continuously or periodically determines a preferred signal direction and controls the delay circuitry to steer the antenna in the preferred direction.

17. The antenna of claim 1, wherein the one or more slots have an oblong shape.

18. The antenna of claim 17, wherein the microstrip feed line extends in the short dimension of the oblong slot.

19. The antenna of claim 1, wherein the main feed line couples with a coax cable connector attachment.

20. The antenna of claim 1, wherein the one or more slots comprises at least two slots that are fed in parallel by the microstrip feed lines.

21. The antenna of claim 1, wherein an equal number of slots are disposed on either side of the main feed line which is center fed with a coax cable connector attachment, thereby providing two halves of the main feed line.

22. The antenna of claim 21, wherein each half of the main feed line has the same resistance, which is also the same total resistance as the parallel combination of the microstrip feed lines that correspond to that half of the main feed line.

23. The antenna of claim 22, wherein the input impedance of the antenna is selected to be the same resistance as said halves of the main feed line.

24. The antenna of claim 1, comprising multiple layers such that at least one of said microstrip feed lines is formed on a first layer and at least one of the slots is defined within a second layer.

25. A high gain, steerable phased array antenna, comprising:

(a) a conducting sheet having at least two slots therein, arranged to provide interferometric functionality;

(b) for each of the slots, an electrical microstrip feed line coupled with the slot to form a magnetically coupled LC resonance element; and (c) a main feed line coupling with the microstrip feed lines;

(d) wherein at least one microstrip feed line includes at least one segment with greater width than other segments to reduce electrical resistance and produce an enhanced q-factor to provide a selected broader bandwidth for the antenna.

26. A high gain, steerable phased array antenna, comprising:

(a) a conducting sheet having at least two slots sharing a common feed line with different lengths from a feed point to each of said at least two slots to form a synthetic aperture;

(b) for each of the slots, an electrical microstrip feed line coupled with the slot to form a magnetically coupled LC resonance element; and (c) a main feed line coupling with the microstrip feed lines; and (d) wherein at least one microstrip feed line includes at least one segment with greater width than other segments to reduce electrical resistance and produce an enhanced q-factor to provide a selected broader bandwidth for the antenna.

27. A high gain, phased array antenna, comprising:

(a) a conducting sheet having a number of one or more slots defined therein, at least one of the slots having a triangular protrusion into the slot;

(b) for each of the slots, an electrical microstrip feed line is electronically coupled with a corresponding slot to form a magnetically-coupled LC resonance element, the electrical microstrip feed line of at least one of the LC resonance elements being coupled with one of the triangular protrusions; and (c) a main feed line coupling with the one or more microstrip feed lines;

(d) wherein at least one slot includes at least one non-rectangular segment producing a shape for the slot that provides a selected radio frequency characteristic for the antenna.

28. The antenna of claim 27, wherein the microstrip feed line is electrically-connected to its corresponding slot.

29. The antenna of claim 27, wherein the microstrip feed line is coupled across its corresponding slot from one side to another.

30. The antenna of claim 27, wherein the microstrip feed line crosses said slot off-center.

31. A mobile phone device including the antenna of claim 27.

32. An IC antenna device including the antenna of claim 27.

33. The antenna of claim 27, wherein the one or more slots comprise at least two oblong slots that overlap in a criss-cross shape design.

34. The antenna of claim 27, wherein the one or more slots comprise at least two oblong slots that overlap in a X-shape design.

35. The antenna of claim 27, wherein the one or more slots comprise at least on slot having bowtie-shaped design.

36. The antenna of claim 27, wherein the one or more slots comprise at least two slots that overlap to in a hook-cross shape, iron-cross or Christmas tree-shape design, or combinations thereof.

37. The antenna of claim 27, wherein the one or more slots comprise at least two slots of different size or shape or both, and thus different resonant frequencies.

38. The antenna of claim 37, wherein the at least two slots overlap each other in a crossed design.

39. The antenna of claim 37, wherein the at least two slots provide dual band or enhanced ultra wide band capability, or both.

40. The antenna of claim 27, further comprising:

(e) delay circuitry for electronically steering the antenna by selectively changing signal phases on the microstrip feed line; and (f) one or more processors operating based on program code that continuously or periodically determines a preferred signal direction and controls the delay circuitry to steer the antenna in the preferred direction.

41. The antenna of claim 27, wherein the one or more slots have an oblong shape.

42. The antenna of claim 41, wherein the microstrip feed line extends in the short dimension of the oblong slot.

43. The antenna of claim 27, wherein the one or more slots have a rectangular shape.

44. The antenna of claim 43, wherein the microstrip feed line extends in the short dimension of the rectangular slot.

45. The antenna of claim 27, wherein the main feed line couples with a coax cable connector attachment.

46. The antenna of claim 27, wherein the one or more slots comprises at least two slots that are fed in parallel by the microstrip feed lines.

47. The antenna of claim 27, wherein an equal number of slots are disposed on either side of the main feed line which is center fed with a coax cable connector attachment, thereby providing two halves of the main feed line.

48. The antenna of claim 47, wherein each half of the main feed line has the same resistance, which is also the same total resistance as the parallel combination of the microstrip feed lines that correspond to that half of the main feed line.

49. The antenna of claim 48, wherein the input impedance of the antenna is selected to be the same resistance as said halves of the main feed line.

50. The antenna of claim 27, comprising multiple layers such that at least one of said microstrip feed lines is formed on a first layer and at least one of the slots is defined within a second layer.

51. A high gain, phased array antenna, comprising:

(a) a conducting sheet having at least two slots therein, arranged to provide interferometric functionality;

(b) for each of the slots, an electrical microstrip feed line is electronically coupled with a corresponding slot to form a magnetically-coupled LC resonance element; and (c) a main feed line coupling with the one or more microstrip feed lines;

(d) wherein at least one slot includes at least one non-rectangular segment producing a shape for the slot that provides a selected radio frequency characteristic for the antenna.

52. A high gain, phased array antenna, comprising:

(a) a conducting sheet having at least two slots sharing a common feed line with different lengths from a feed point to each of said at least two slots to form a synthetic aperture;

(b) for each of the slots, an electrical microstrip feed line is electronically coupled with a corresponding slot to form a magnetically-coupled LC resonance element; and (c) a main feed line coupling with the one or more microstrip feed lines;

(d) wherein at least one slot includes at least one non-rectangular segment producing a shape for the slot that provides a selected radio frequency characteristic for the antenna.

* * * * *